US005555748A

United States Patent [19]

Campbell et al.

[11] Patent Number: 5,555,748

[45] Date of Patent: Sep. 17, 1996

[54] HYDROCARBON GAS PROCESSING

[75] Inventors: Roy E. Campbell; John D. Wilkinson; Hank M. Hudson, all of Midland; Michael C. Pierce, Odessa, all of Tex.

[73] Assignee: Elcor Corporation, Dallas, Tex.

[21] Appl. No.: 477,444

[22] Filed: Jun. 7, 1995

[51] Int. Cl.[6] ..... F25J 3/02

[52] U.S. Cl. ..... 62/621; 62/630

[58] Field of Search ..... 62/621, 620, 630

[56] References Cited

U.S. PATENT DOCUMENTS

| | | | |
|---|---|---|---|
| 2,880,592 | 4/1959 | Davidson et al. | 62/621 |
| 3,292,380 | 12/1966 | Bucklin | 62/621 |
| 4,157,904 | 6/1979 | Campbell et al. | 62/27 |
| 4,171,964 | 10/1979 | Campbell et al. | 62/24 |
| 4,278,457 | 7/1981 | Campbell et al. | 62/24 |
| 4,519,824 | 5/1985 | Huebel | 62/26 |
| 4,617,039 | 10/1986 | Buck | 62/621 |
| 4,687,499 | 8/1987 | Aghili | 62/24 |
| 4,698,081 | 10/1987 | Aghili | 62/621 |
| 4,710,214 | 12/1987 | Sharma et al. | 62/621 |
| 4,854,955 | 8/1989 | Campbell et al. | 62/24 |
| 4,869,740 | 9/1989 | Campbell et al. | 62/24 |
| 4,889,545 | 12/1989 | Campbell et al. | 62/24 |
| 5,275,005 | 1/1994 | Campbell et al. | 62/621 |

*Primary Examiner*—Christopher Kilner

*Attorney, Agent, or Firm*—Brumbaugh, Graves, Donohue & Raymond

[57] ABSTRACT

A process for the recovery of ethane, ethylene, propane, propylene and heavier hydrocarbon components from a hydrocarbon gas stream is disclosed. The stream is cooled to partially condense it, then separated to provide a first vapor stream and a first condensed stream. The first vapor stream is divided into first and second streams, then the first stream is combined with the first condensed stream. The combined stream is cooled and expanded to an intermediate pressure to partially condense it, then separated to provide a second vapor stream and a second condensed stream. The second vapor stream is cooled at the intermediate pressure to condense substantially all of it and is thereafter expanded to the fractionation tower pressure and supplied to the fractionation tower at a top feed position. The second condensed stream is subcooled at the intermediate pressure, expanded to the tower pressure, and is supplied to the column at a first mid-column feed position. The second stream is expanded to the tower pressure and is then supplied to the column at a second mid-column feed position. The quantities and temperatures of the feeds to the column are effective to maintain the column overhead temperature at a temperature whereby the major portion of the desired components is recovered. In an alternative embodiment, the combined stream is cooled at essentially inlet pressure to partially condense it, then separated at pressure to provide the second vapor stream and the second condensed stream.

17 Claims, 13 Drawing Sheets

HYDROCARBON GAS PROCESSING

BACKGROUND 0F THE INVENTION

This invention relates to a process for the separation of a gas containing hydrocarbons.

Ethylene, ethane, propylene, propane and heavier hydrocarbons can be recovered from a variety of gases, such as natural gas, refinery gas, and synthetic gas streams obtained from other hydrocarbon materials such as coal, crude oil, naphtha, oil shale, tar sands, and lignite. Natural gas usually has a major proportion of methane and ethane, i.e., methane and ethane together comprise at least 50 mole percent of the gas. The gas may also contain relatively lesser amounts of heavier hydrocarbons such as propane, butanes, pentanes and the like, as well as hydrogen, nitrogen, carbon dioxide and other gases.

The present invention is generally concerned with the recovery of ethylene, ethane, propylene, propane and heavier hydrocarbons from such gas streams. A typical analysis of a gas stream to be processed in accordance with this invention would be, in, approximate mole percent, 86.1% methane, 7.8% ethane and other $C_2$ components, 3.3% propane and other $C_3$ components, 0.5% iso-butane 0.7% normal butane, 0.6% pentanes plus, with the balance made up of nitrogen and carbon dioxide. Sulfur containing gases are also sometimes present.

The historically cyclic fluctuations in the prices of both natural gas and its natural gas liquid (NGL) constituents have reduced the incremental value of ethane and heavier components as liquid products. This has resulted in a demand for processes that can provide more efficient recoveries of these products. Available processes for separating these materials include those based upon cooling and refrigeration of gas, oil absorption, and refrigerated oil absorption. Additionally, cryogenic processes have become popular because of the availability of economical equipment that produces power while simultaneously expanding and extracting heat from the gas being processed. Depending upon the pressure of the gas source, the richness (ethane and heavier hydrocarbons content) of the gas, and the desired end products, each of these processes or a combination thereof may be employed.

The cryogenic expansion process is now generally preferred for ethane recovery because it provides maximum simplicity with ease of start up, operating flexibility, good efficiency, safety, and good reliability. U.S. Pat. Nos. 4,157,904, 4,171,964, 4,278,457, 4,519,824, 4,687,499, 4,854,955, 4,869,740, and 4,889,545 and co-pending application Ser. No. 08/337,172 describe relevant processes.

In a typical cryogenic expansion recovery process, a feed gas stream under pressure is cooled by heat exchange with other streams of the process and/or external sources of refrigeration such as a propane compression-refrigeration system. As the gas is cooled, liquids may be condensed and collected in one or more separators as high-pressure liquids containing some of the desired $C_{2+}$ components. Depending on the richness of the gas and the amount of liquids formed, the high-pressure liquids may be expanded to a lower pressure and fractionated. The vaporization occurring during expansion of the liquids results in further cooling of the stream. Under some conditions, pre-cooling the high pressure liquids prior to the expansion may be desirable in order to further lower the temperature resulting from the expansion. The expanded stream, comprising a mixture of liquid and vapor, is fractionated in a distillation (demethanizer) column. In,the column, the expansion cooled stream(s) is (are) distilled to separate residual methane, nitrogen, and other volatile gases as overhead vapor from the desired $C_2$ components, $C_3$ components, and heavier hydrocarbon components as bottom liquid product.

If the feed gas is not totally condensed (typically it is not), the vapor remaining from the partial condensation can be split into two or more streams. One portion of the vapor is passed through a work expansion machine or engine, or an expansion valve, to a lower pressure at which additional liquids are condensed as a result of further cooling of the stream. The pressure after expansion is essentially the same as the pressure at which the distillation column is operated. The combined vapor-liquid phases resulting from the expansion are supplied as feed to the column.

The remaining portion of the vapor is cooled to substantial condensation by, heat exchange with other process streams, e.g., the cold fractionation tower overhead. Depending on the amount of high-pressure liquid available, some or all of the high-pressure liquid may be combined with this vapor portion prior to cooling. The resulting cooled stream is then expanded through an appropriate expansion device, such as an expansion valve, to the pressure at which the demethanizer is operated. During expansion, a portion of the liquid will vaporize, resulting in cooling of the total stream. The flash expanded stream is then supplied as top feed to the demethanizer. Typically, the vapor portion of the expanded stream and the demethanizer overhead vapor combine in an upper separator section in the fractionation tower as residual methane product gas. Alternatively, the cooled and expanded stream may be supplied to a separator to provide vapor and liquid streams. The vapor is combined with the tower overhead and the liquid is supplied to the column as a top column feed.

In the ideal operation of such a separation process, the residue gas leaving the process will contain substantially all of the methane in the feed gas with essentially none of the heavier hydrocarbon components and the bottoms fraction leaving the demethanizer will contain substantially all of the heavier hydrocarbon components with essentially no methane or more volatile components. In practice, however, this ideal situation is not obtained for the reason that the conventional demethanizer is operated largely as a stripping column. The methane product of the process, therefore, typically comprises vapors leaving the top fractionation stage of the column, together with vapors not subjected to any rectification step. Considerable losses of $C_2$ components occur because the top liquid feed contains substantial quantities of $C_2$ components and heavier hydrocarbon components, resulting in corresponding equilibrium quantities of $C_2$ components and heavier hydrocarbon components in the vapors leaving the top fractionation stage of the demethanizer. The loss of these desirable components could be significantly reduced if the rising vapors could be brought into contact with a significant quantity of liquid (reflux), containing very little $C_2$ components and heavier hydrocarbon components; that is, reflux capable of absorbing the $C_2$ components and heavier hydrocarbon components from the vapors. The present invention provides a means for achieving this objective and significantly improving the recovery of the desired products.

In accordance with the present invention, it has been found that $C_2$ recoveries in excess of 96 percent can be obtained. Similarly, in those instances where recovery of $C_2$ components is not desired, $C_3$ recoveries in excess of 98% can be maintained. In addition, the present invention makes possible essentially 100 percent separation of methane (or $C_2$ components) and lighters components from the $C_2$ components (or $C_3$ components) and heavier hydrocarbon components at reduced energy requirements. The present invention, although applicable at lower pressures and warmer temperatures, is particularly advantageous when processing feed gases in the range of 600 to 1000 psia or higher under conditions requiring column overhead temperatures of −110° F. or colder.

For a better understanding of the present invention, reference is made to the following examples and drawings. Referring to the drawings:

FIG. 1 is a flow diagram of a cryogenic expansion natural gas processing plant of the prior art according to U.S. Pat. No. 4,278,457;

FIG. 2 is a flow diagram of a cryogenic expansion natural gas processing plant of an alternative prior art system according to U.S. Pat. No. 4,519,824;

FIG. 3 is a flow diagram of a cryogenic expansion natural gas processing plant of an alternative prior art system according to U.S. Pat. No. 4,157,904;

FIG. 4 is a flow diagram of a cryogenic expansion natural gas processing plant of an alternative prior art system according to U.S. Pat. No. 4,687,499;

FIG. 5 is a flow diagram of a cryogenic expansion natural gas processing plant of an alternative system according to co-pending application Ser. No. 08/337,172;

FIG. 6 is a flow diagram of a cryogenic expansion natural gas processing plant of an alternative prior art system according to U.S. Pat. No. 4,889,545;

In the following explanation of the above figures, tables are provided summarizing flow rates calculated for representative process conditions. In the tables appearing herein, the values for flowrates (in pound moles per hour) have been rounded to the nearest whole number for convenience. The total stream rates shown in the tables include all nonhydrocarbon components and hence are generally larger than the sum of the stream flow rates for the hydrocarbon components. Temperatures indicated are approximate values rounded to the nearest degree. It should also be noted that the process design calculations performed for the purpose of comparing the processes depicted in the figures are based on the assumption of no heat leak from (or to) the surroundings to (or from) the process. The quality of commercially available insulating materials makes this a very reasonable assumption and one that is typically made by those skilled in the art.

DESCRIPTION OF THE PRIOR ART

Figure 1:
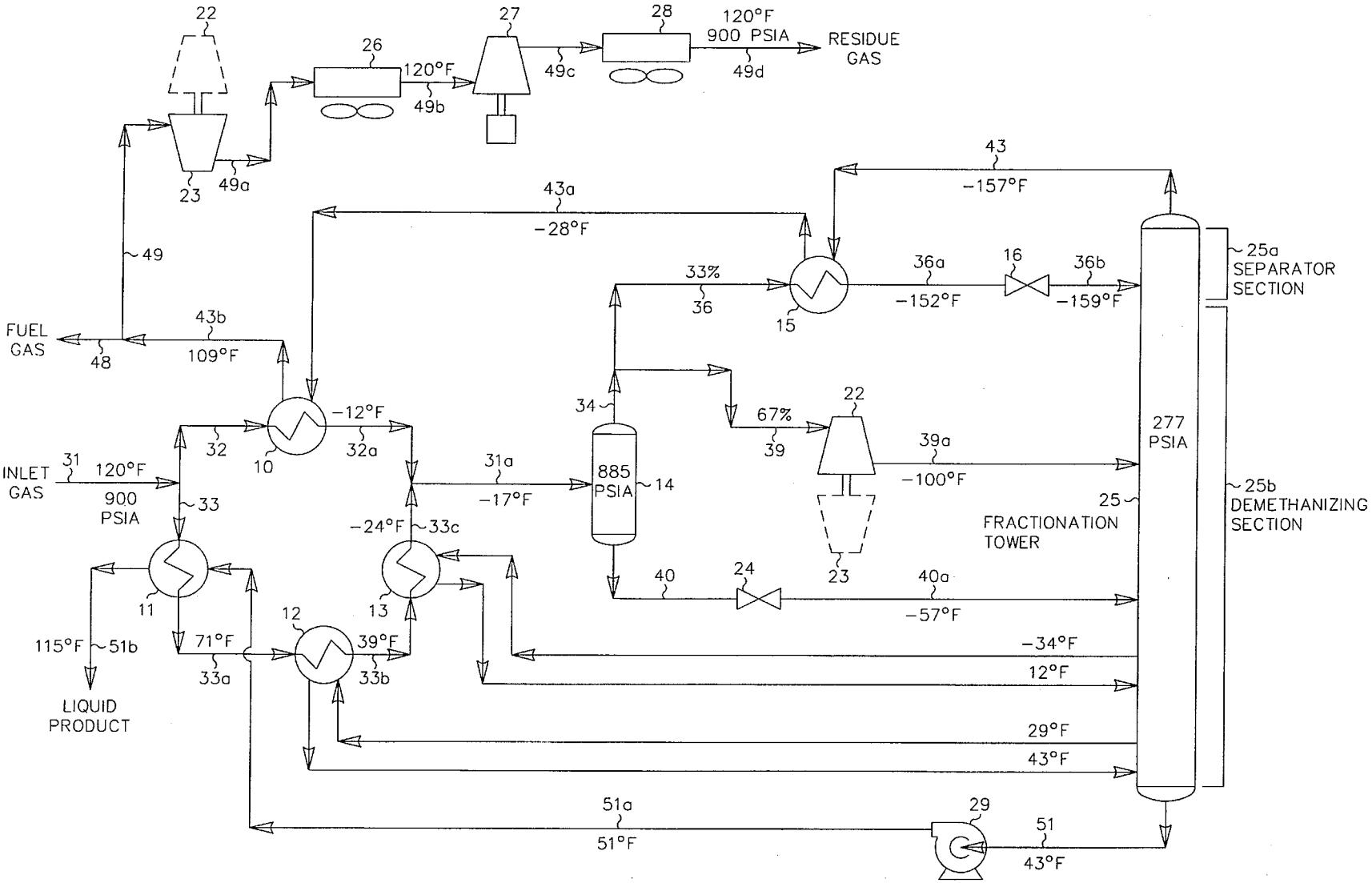
FIG. 1 (PRIOR ART)

Referring now to FIG. 1, in a simulation of the process according to U.S. Pat. No. 4,278,457, inlet gas enters the plant at 120° F. and 900 psia as stream 31. If the inlet gas contains a concentration of sulfur compounds which would prevent the product streams from meeting specifications, the sulfur compounds are removed by appropriate pretreatment of the feed gas (not illustrated). In addition, the feed stream is usually dehydrated to prevent hydrate (ice) formation under cryogenic conditions. Solid desiccant has typically been used for this purpose.

The feed stream is divided into two parallel streams, 32 and 33. The upper stream, 32, is cooled to −12° F. (stream 32*a*) by heat exchange with cool residue gas at −28° F. in exchanger 10. (The decision as to whether to use more than one heat exchanger for the indicated cooling services will depend on a number of factors including, but not limited to, inlet gas flow rate, heat exchanger size, residue gas temperature, etc.).

The lower stream, 33, is cooled to 71° F. by heat exchange with bottom liquid product (stream 51*a*) from the demethanizer bottoms pump, 29, in exchanger 11. The cooled stream, 33*a*, is further cooled to 39° F. (stream 33*b*) by demethanizer liquid at 29° F. in demethanizer reboiler 12, and to −24° F. (stream 33*c*) by demethanizer liquid at −34° F. in demethanizer side reboiler 13.

Following cooling, the two streams, 32*a* and 33*c*, recombine as stream 31*a*. The recombined stream then enters separator 14 at −17° F. and 885 psia where the vapor (stream 34) is separated from the condensed liquid (stream 40).

The vapor (stream 34) from separator 14 is divided into two streams, 36 and 39. Stream 36, containing about 33 percent of the total vapor, passes through heat exchanger 15 in heat exchange relation with the demethanizer overhead vapor stream 43 resulting in cooling and substantial condensation of the stream. The substantially condensed stream 36*a* at −152° F. is then flash expanded through an appropriate expansion device, such as expansion valve 16, to the operating pressure (approximately 277 psia) of the fractionation tower 25. During expansion a portion of the stream is vaporized, resulting in cooling of the total stream. In the process illustrated in FIG. 1, the expanded stream 36*b* leaving expansion valve 16 reaches a temperature of −159° F. and is supplied to separator section 25*a* in the upper region of fractionation tower 25. The liquids separated therein become the top feed to demethanizing section 25*b*.

The remaining 67 percent of the vapor from separator 14 (stream 39) enters a work expansion machine 22 in which mechanical energy is extracted from this portion of the high pressure feed. The machine 22 expands the vapor substantially isentropically from a pressure of about 885 psia to a pressure of about 277 psia, with the work expansion cooling the expanded stream 39*a* to a temperature of approximately −100° F. The typical commercially available expanders are capable of covering on the order of 80–85% of the work theoretically available in an ideal isentropic expansion. The work recovered is often used to drive a centrifugal compressor (such as item 23), that can be used to re-compress the residue gas (stream 49), for example. The expanded and partially condensed stream 39*a* is supplied as feed to the distillation column at an intermediate point. The separator liquid (stream 40) is likewise expanded to 277 psia by expansion valve 24, cooling stream 40 to −57° F. (stream 40*a*) before it is supplied to the demethanizer in fractionation tower 25 at a lower mid-column feed point.

The demethanizer in fractionation tower 25 is a conventional distillation column containing a plurality of vertically spaced trays, one or more packed beds, or some combination of trays and packing. As is often the case in natural gas processing plants, the fractionation tower may consist of two sections. The upper section 25*a* is a separator wherein the partially vaporized top feed is divided into its respective vapor and liquid portions, and wherein the vapor rising from the lower distillation or demethanizing section 25*b* is combined with the vapor portion of the top feed to form the cold residue gas distillation stream 43 which exits the top of the tower. The lower, demethanizing section 25b contains the trays and/or packing and provides the necessary contact between the liquids falling downward and the vapors rising upward. The demethanizing section also includes reboilers which heat and vaporize a portion of the liquids flowing down the column to provide the stripping vapors which flow up the column.

The liquid product stream 51 exits the bottom of the tower at 43° F., based on a typical specification of a methane to ethane ratio of 0.028:1 on a molar basis in the bottom product. The stream is pumped to approximately 805 psia, stream 51a, in pump 29. Stream 51a, now at about 51° F., is warmed to 115° F. (stream 51b) in exchanger 11 as it provides cooling to stream 33. (The discharge pressure of the pump is usually set by the ultimate destination of the liquid product. Generally the liquid product flows to storage and the pump discharge pressure is set so as to prevent any vaporization of stream 51b as it is warmed in exchanger 11.)

The residue gas (stream 43) passes countercurrently to the incoming feed gas in: (a) heat exchanger 15 where it is heated to −28° F. (stream 43a) and (b) heat exchanger 10 where it is heated to 109° F. (stream 43b). A portion of the stream (1.5%) is withdrawn at this point (stream 48) to be used as fuel gas for the plant; the remainder (stream 49) is then re-compressed in two stages. The first stage is compressor 23 driven by expansion machine 22, followed by after-cooler 26. The second stage is compressor 27 driven by a supplemental power source which compresses the residue gas stream 49b) to sales line pressure (usually on the order of the inlet pressure). After cooling in discharge cooler 28, the residue gas product (stream 49d) flows to the sales gas pipeline at 120° F. and 900 psia.

A summary of stream flow rates and energy consumption for the process illustrated in FIG. 1 is set forth in the following table:

TABLE I (FIG. 1)
Stream Flow Summary - (Lb. Moles/Hr)

| Stream | Methane | Ethane | Propane | Butanes+ | Total |
|---|---|---|---|---|---|
| 31 | 23630 | 2152 | 901 | 493 | 27451 |
| 34 | 22974 | 1906 | 651 | 195 | 25994 |
| 40 | 656 | 246 | 250 | 298 | 1457 |
| 36 | 7547 | 626 | 214 | 64 | 8539 |
| 39 | 15427 | 1280 | 437 | 131 | 17455 |
| 43 | 23573 | 119 | 4 | 0 | 23932 |
| 51 | 57 | 2033 | 897 | 493 | 3519 |
| Recoveries* | | | | | |
| Ethane | | | | 94.46% | |
| Propane | | | | 99.50% | |
| Butanes+ | | | | 99.96% | |
| Horsepower | | | | | |
| Residue Compression | | | | 15,200 | |

*(Based on un-rounded flow rates)

The prior art illustrated in FIG. 1 is limited to the ethane recovery shown in Table I by equilibrium at the top of the column with the top feed (stream 36b) to the demethanizer, and by the temperatures of the lower feeds (streams 39a and 40a) which provide refrigeration to the tower. Lowering the feed gas temperature at separator 14 below that shown in FIG. 1 will increase the recovery slightly by lowering the temperatures of streams 39a and 40a, but only at the expense of reduced power recovery in expansion machine 22 and the corresponding increase in the residue compression horsepower. Alternatively, the ethane recovery of the prior art process of FIG. 1 can be improved by lowering the operating pressure of the demethanizer, but to do so will increase the residue compression horsepower inordinately. In either case, the ultimate ethane recovery possible will still be dictated by the composition of the top liquid feed to the demethanizer.

Figure 2:
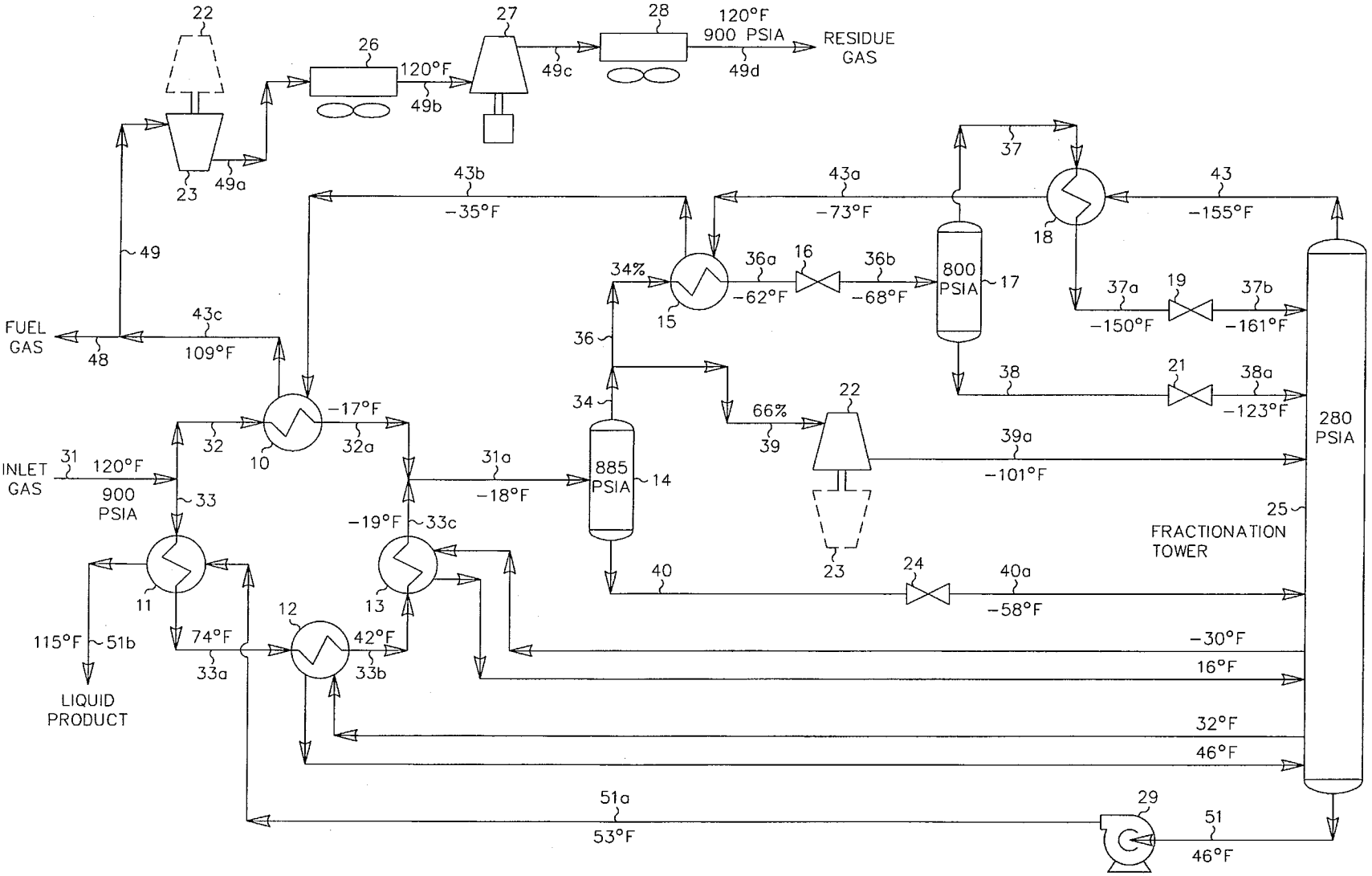
FIG. 2 (PRIOR ART)

One way to achieve higher ethane recovery without lowering the demethanizer operating pressure is to create a leaner (lower $C_{2+}$ content) top (reflux) feed. FIG. 2 represents an alternative prior art process in accordance with U.S. Pat. No. 4,519,824 that uses additional prefractionation of the incoming feed streams to provide a leaner top feed to the demethanizer. The process of FIG. 2 has been applied to the same feed gas composition and conditions as described above for FIG. 1. In the simulation of this process, as in the simulation for the process of FIG. 1, operating conditions were selected to maximize the ethane recovery for a given level of energy consumption.

The feed stream 31 is divided into two parallel streams, 32 and 33. The upper stream, 32, is cooled to −17° F. (stream 32a) by heat exchange with the cool residue gas at −35° F. (stream 43b) in exchanger 10. The lower stream, 33, is cooled to 74° F. by heat exchange with bottom liquid product at 53° F. (stream 51a) from the demethanizer bottoms pump, 29, in exchanger 11. The cooled stream, 33a, is further cooled to 42° F. (stream 33b) by demethanizer liquid at 32° F. in demethanizer reboiler 12, and to −19° F. (stream 33c) by demethanizer liquid at −30° F. in demethanizer side reboiler 13.

Following cooling, the two streams, 32a and 33c, recombine as stream 31a. The recombined stream then enters separator 14 at −18° F. and 885 psia where the vapor (stream 34) is separated from the condensed liquid (stream 40).

The vapor (stream 34) from separator 14 is divided into two streams, 36 and 39. Stream 36, containing about 34 percent of the total vapor, is cooled to −62° F. and partially condensed in heat exchanger is by heat exchange with cool residue gas (stream 43a) at −73° F. The partially condensed stream 36a is then flash expanded through an appropriate expansion device, such as expansion valve 16, to an intermediate pressure of about 800 psia. The flash expanded stream 36b, now at −68° F., enters intermediate separator 17 where the vapor (stream 37) is separated from the condensed liquid (stream 38).

The vapor (stream 37) from intermediate separator 17 passes through heat exchanger 18 in heat exchange relation with the demethanizer overhead vapor stream 43 resulting in cooling and substantial condensation of the stream. The substantially condensed stream 37a at −150° F. is then flash expanded through an appropriate expansion device, such as expansion valve 19, to the operating pressure (approximately 280 psia) of the fractionation tower 25. During expansion a portion of the stream is vaporized, resulting in cooling of the total stream. In the process illustrated in FIG. 2, the expanded stream 37b leaving expansion valve 19 reaches a temperature of −161° F. and is supplied to the demethanizer in fractionation tower 25 as the top feed. The intermediate separator liquid (stream 38) is likewise expanded to 280 psia by expansion valve 21, cooling stream 38 to −123° F. (stream 38a) before it is supplied to the demethanizer in fractionation tower 25 at an upper mid-column feed point.

Returning to the second portion of the vapor from separator 14, stream 39, the remaining 66 percent of the vapor enters a work expansion machine 22 in which mechanical energy is extracted from this portion of the high pressure feed. The machine 22 expands the vapor substantially isentropically from a pressure of about 885 psia to the operating pressure of the demethanizer of about 280 psia, with the work expansion cooling the expanded stream to a temperature of approximately −101° F. The expanded and partially condensed stream 39*a* is supplied as feed to the distillation column at a mid-column feed point. The separator liquid (stream 40) is likewise expanded to 280 psia by expansion valve 24, cooling stream 40 to −58° F. (stream 40*a*) before it is supplied to the demethanizer in fractionation tower 25 at a lower mid-column feed point.

The liquid product stream 51 exits the bottom of tower 25 at 46° F. This stream is pumped to approximately 805 psia, stream 51*a*, in pump 29. Stream 51*a*, now at 53° F., is warmed to 115° F. (stream 51*b*) in exchanger 11 as it provides cooling to stream 33.

The residue gas (stream 43) passes countercurrently to the incoming feed gas in: (a) heat exchanger 18 where it is heated to −73° F. (stream 43*a*), (b) heat exchanger 15 where it is heated to −35° F. (stream 43*b*), and (c) heat exchanger 10 where it is heated to 109° F. (stream 43*c*). A portion of the stream (1.5%) is withdrawn at this point (stream 48) to be used as fuel gas for the plant; the remainder (stream 49) is then re-compressed in two stages. The first stage is compressor 23 driven by expansion machine 22, followed by after-cooler 26. The second stage is compressor 27 driven by a supplemental power source which compresses the residue gas to sales line pressure (stream 49*c*). After cooling in discharge cooler 28, the residue gas product (stream 49*d*) flows to the sales gas pipeline at 120° F. and 900 psia.

A summary of stream flow rates and energy consumption for the process illustrated in FIG. 2 is set forth in the following table:

TABLE II (FIG. 2)
Stream Flow Summary - (Lb. Moles/Hr)

| Stream | Methane | Ethane | Propane | Butanes+ | Total |
|---|---|---|---|---|---|
| 31 | 23630 | 2152 | 901 | 493 | 27451 |
| 34 | 22946 | 1896 | 643 | 191 | 25945 |
| 40 | 684 | 256 | 258 | 302 | 1506 |
| 36 | 7695 | 636 | 216 | 64 | 8700 |
| 39 | 15251 | 1260 | 427 | 127 | 17245 |
| 37 | 6803 | 410 | 84 | 12 | 7390 |
| 38 | 892 | 226 | 132 | 52 | 1310 |
| 43 | 23575 | 185 | 3 | 0 | 24018 |
| 51 | 55 | 1967 | 898 | 493 | 3433 |
| | Recoveries* | | | | |
| | Ethane | | | 91.41% | |
| | Propane | | | 99.69% | |
| | Butanes+ | | | 99.99% | |
| | Horsepower | | | | |
| | Residue Compression | | | 15,200 | |

*(Based on un-rounded flow rates)

Comparison of the ethane concentration in the top column feed for the FIG. 2 process (stream 37 in Table II above) with the ethane concentration in the top column feed for the FIG. 1 process (stream 36 in the preceding Table I) shows that the FIG. 2 process does produce a significantly leaner top feed to the demethanizer by additional prefractionation of the incoming feed gases. However, comparison of the recovery levels displayed in Tables I and II shows that the leaner top feed for the FIG. 2 process does not provide an improvement in liquids recovery. Compared to the FIG. 1 process, the ethane recovery of the FIG. 2 process drops sharply from 94.46% to 91.41%, while the propane recovery improves slightly from 99.50% to 99.69% and the butanes+ recovery improves slightly from 99.96% to 99.99%. Although the top column feed in the FIG. 2 process is leaner in ethane content than the FIG. 1 process, the other feed to the top section of the column (stream 38*a*) is warmer than in the FIG. 1 process, resulting in less total refrigeration to the top section of the demethanizer (for a given utility level) and a corresponding loss in ethane recovery from the tower.

Figure 3:
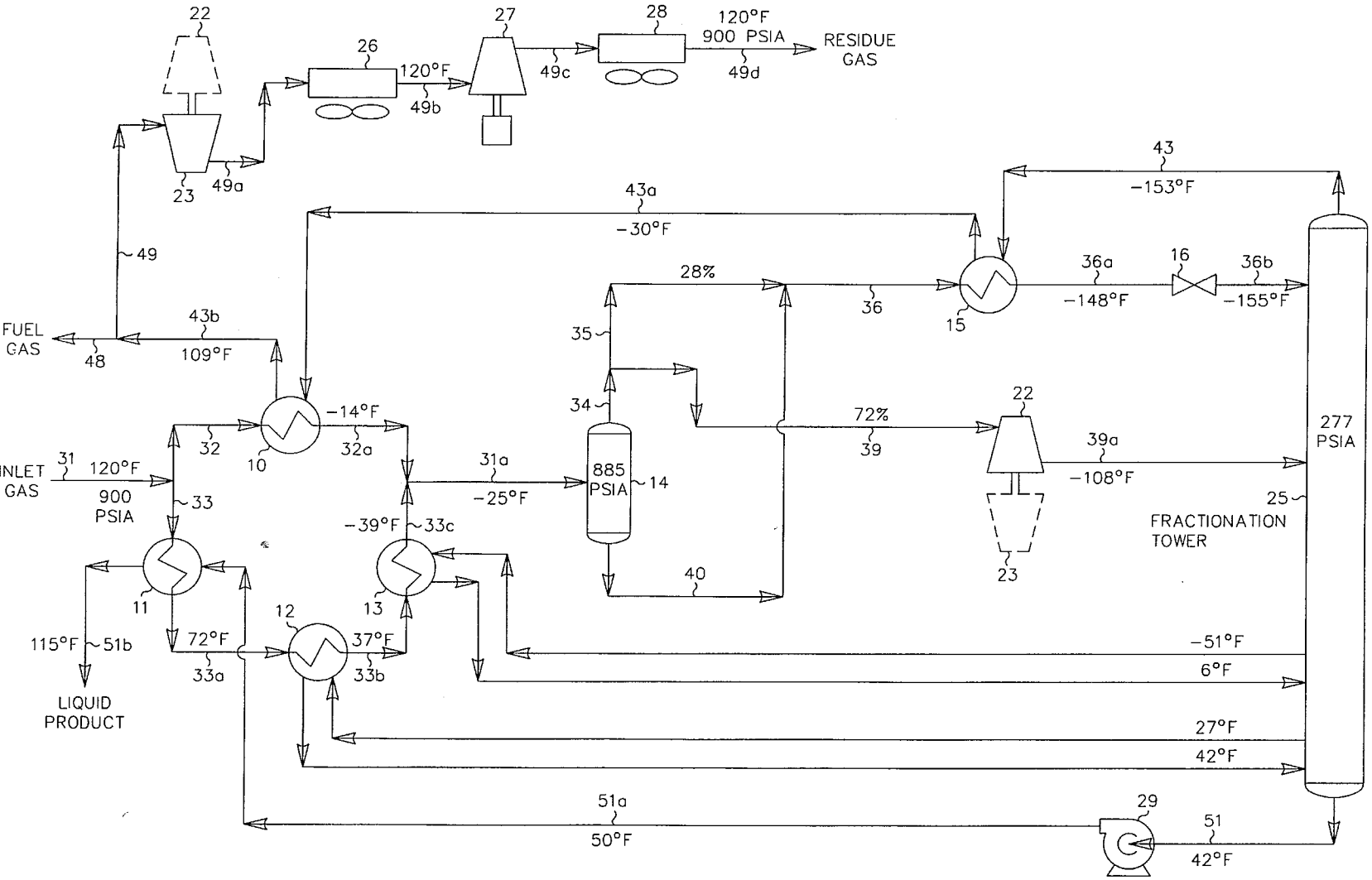
FIG. 3 (PRIOR ART)
Figure 4:
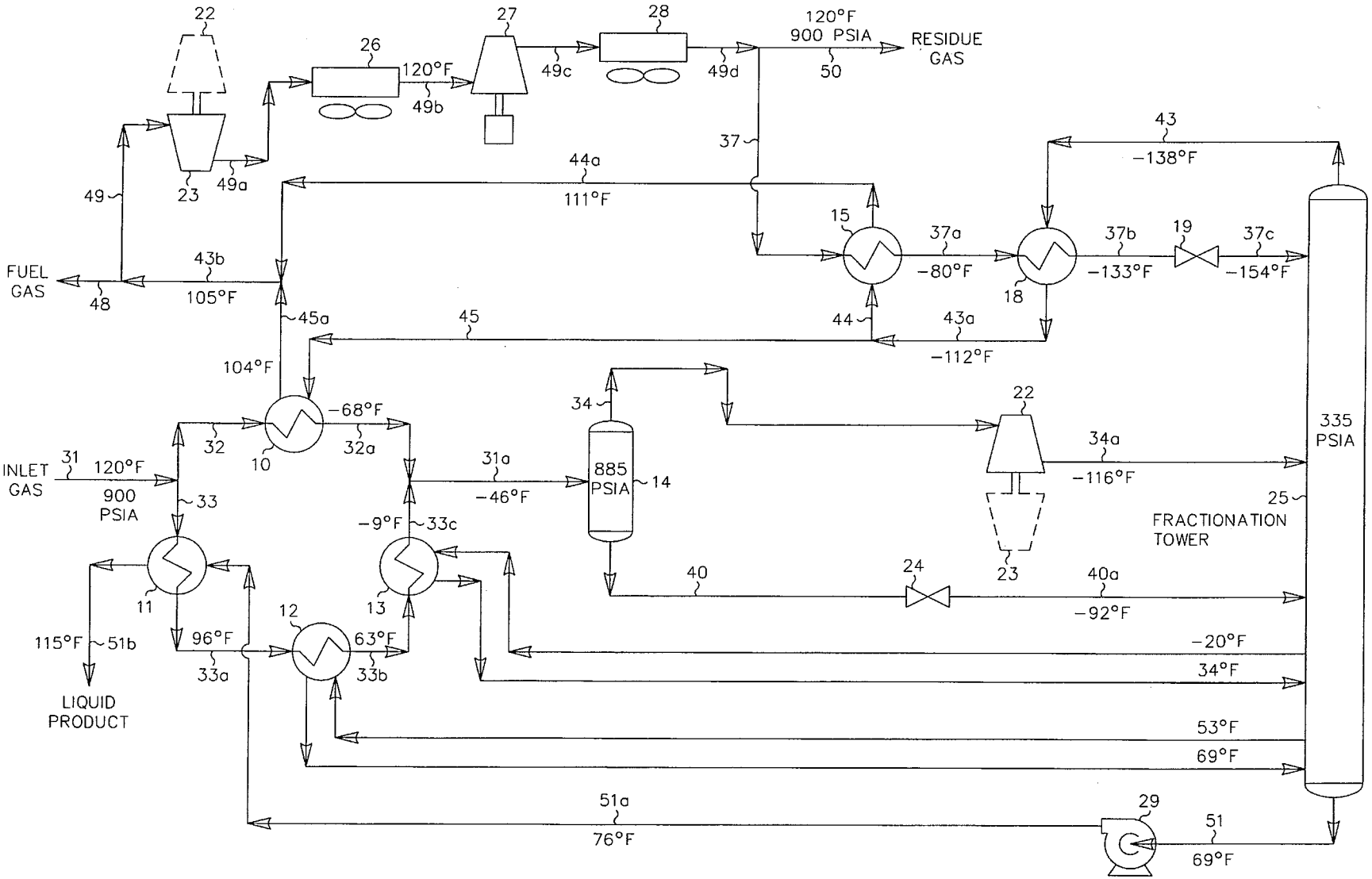
FIG. 4 (PRIOR ART)
Figure 5:
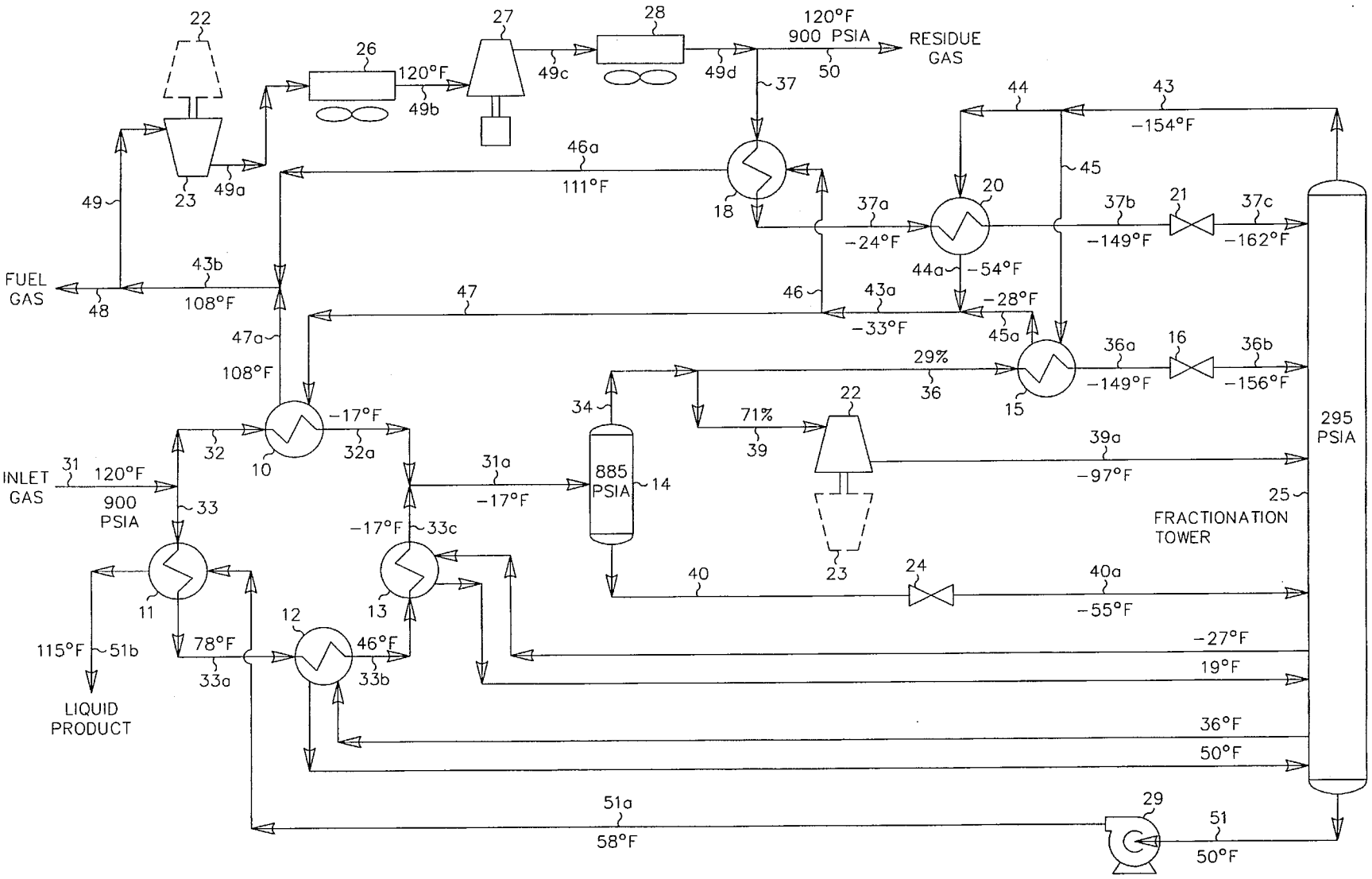
FIG. 5 (PRIOR ART)
Figure 6:
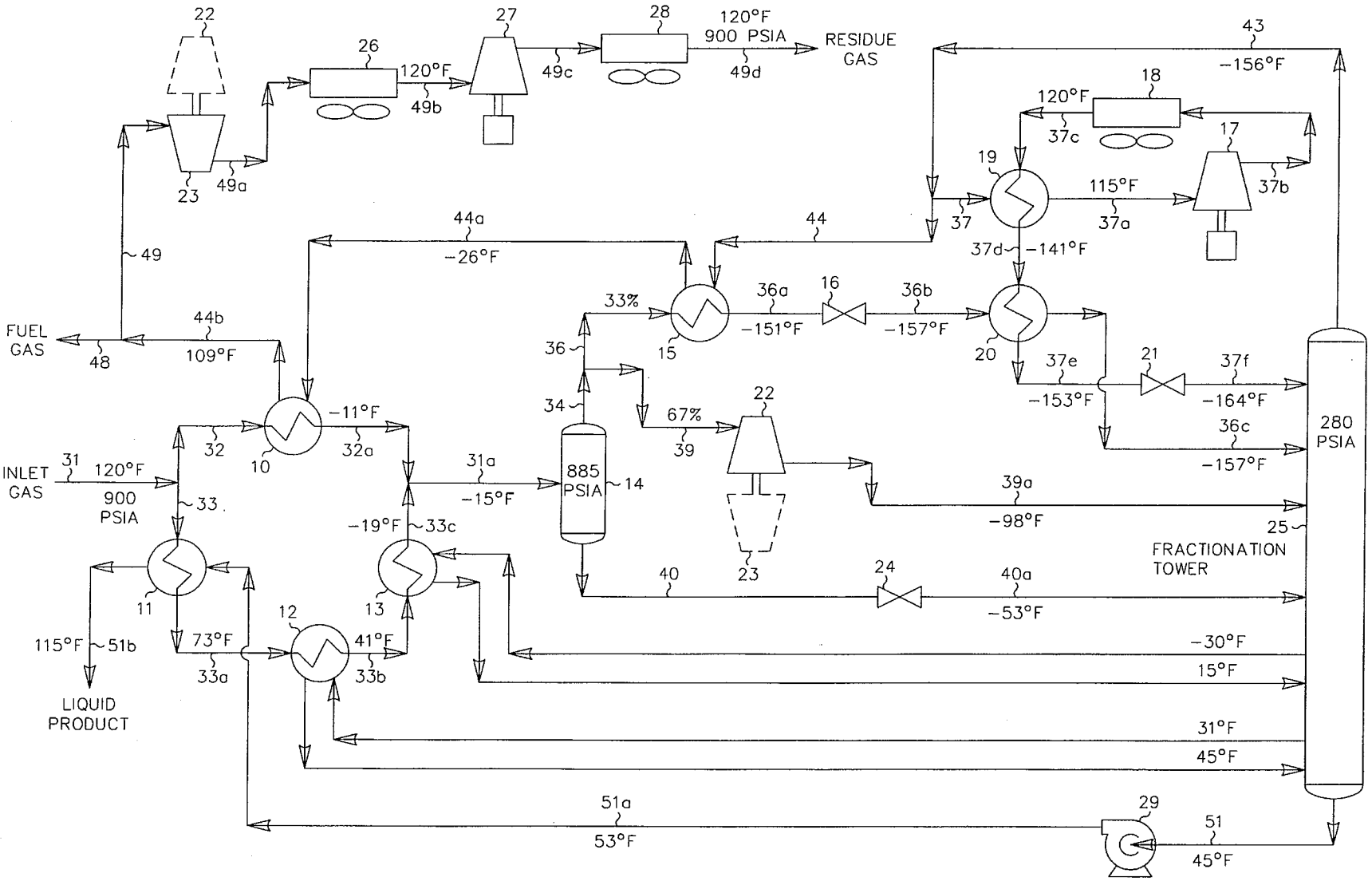
FIG. 6 (PRIOR ART)

Other prior art processes were investigated to determine if other methods for producing a leaner top column feed, or for increasing the refrigeration to the top section of the demethanizer, would improve the ethane recovery over that of the FIG. 1 process. FIG. 3 illustrates a flow diagram according to U.S. Pat. No. 4,157,904; FIG. 4 illustrates a flow diagram according to U.S. Pat. No. 4,687,499; FIG. 5 is a flow diagram according to co-pending application Ser. No. 08/337,172; and FIG. 6 is a flow diagram according to U.S. Pat. No. 4,889,545. The processes of FIGS. 3 through 6 have been applied to the same feed gas composition and conditions as described above for FIGS. 1 and 2. In the simulation of these processes, as in the simulation for the process of FIGS. 1 and 2, operating conditions were selected to maximize ethane recovery for a given level of energy consumption. The results of these process simulations are summarized in the following table:

TABLE III (FIGS. 3 through 6)
Process Performance Summary

| FIG. | Recoveries: Ethane | Recoveries: Propane | Recoveries: Butanes+ | Total Compression Horsepower |
|---|---|---|---|---|
| 3 | 93.69% | 99.12% | 99.88% | 15,201 |
| 4 | 76.17% | 100.00% | 100.00% | 15,200 |
| 5 | 92.49% | 99.96% | 100.00% | 15,201 |
| 6 | 94.17% | 99.47% | 99.96% | 15,201 |

Comparison of the recovery levels displayed in Table III with those shown in Table I indicates that none of the prior art processes illustrated in FIGS. 3 through 6 improve the ethane recovery efficiency. For the same utility consumption, none of these prior art processes are able to achieve a leaner top column feed stream without reducing the refrigeration supplied to the top of the column, with the result that the ethane recovery does not improve relative to the FIG. 1 process. In fact, all of the prior art processes illustrated in FIGS. 2 through 6 achieve lower ethane recoveries (some significantly lower) than the FIG. 1 process.

DESCRIPTION OF THE INVENTION

EXAMPLE 1

Figure 7:
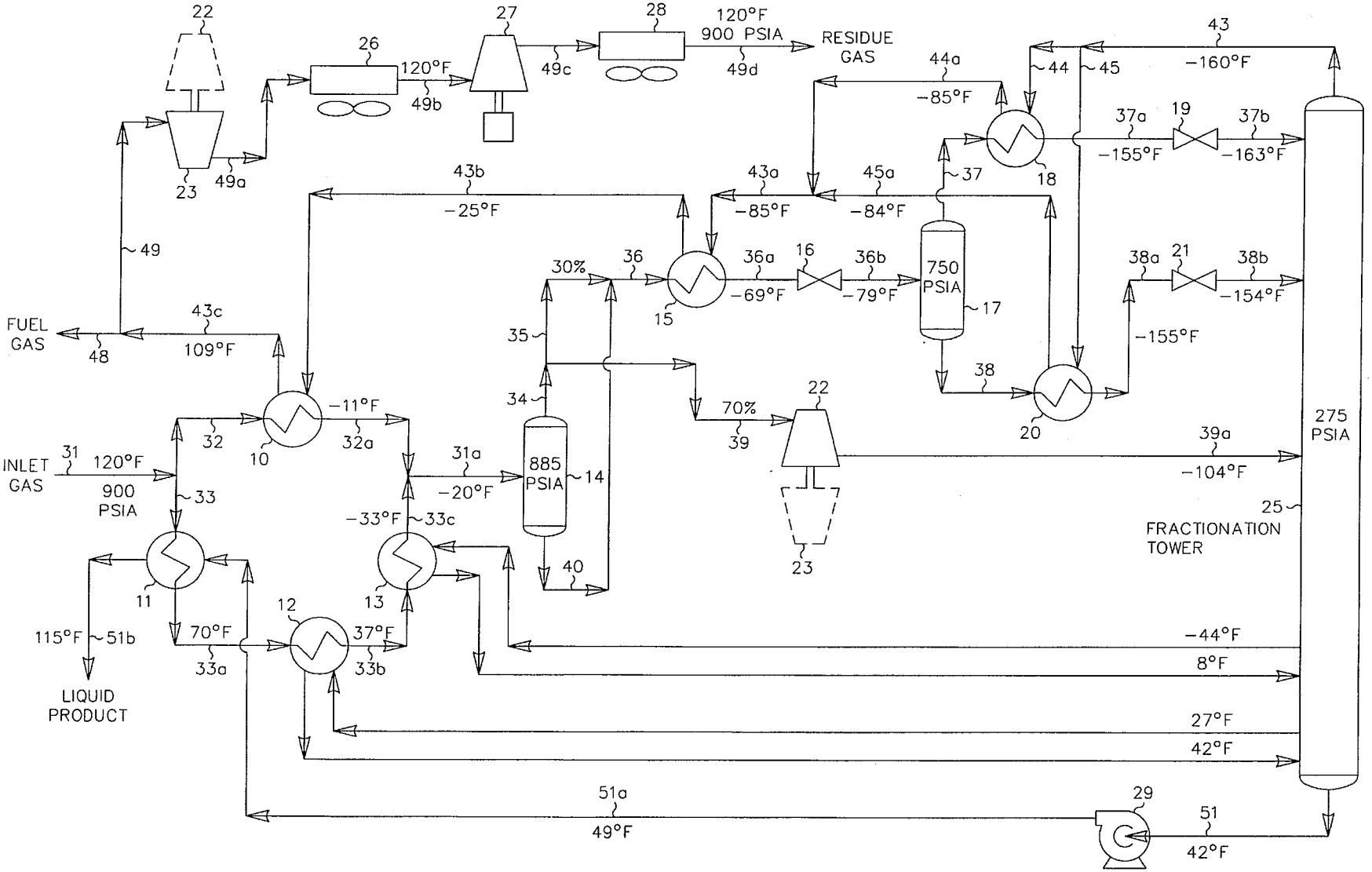
FIG. 7 is a flow diagram of a natural gas processing plant in accordance with the present invention.

FIG. 7 illustrates a flow diagram of a process in accordance with the present invention. The feed gas composition and conditions considered in the process presented in FIG. 7 are the same as those in FIGS. 1 through 6. Accordingly, the FIG. 7 process can be compared with the FIGS. 1 through 6 processes to illustrate the advantages of the present invention.

In the simulation of the FIG. 7 process, inlet gas enters at 120° F. and a pressure of 900 psia as stream 31. The feed stream is divided into two parallel streams, 32 and 33. The upper stream, 32, is cooled to −11° F. by heat exchange with the cool residue gas (stream 43*b*) at −25° F. in heat exchanger 10.

The lower stream, 33, is cooled to 70° F. by heat exchange with liquid product at 49° F. (stream 51*a*) from the demethanizer bottoms pump, 29, in exchanger 11. The cooled stream, 33*a*, is further cooled to 37° F. (stream 33*b*) by demethanizer liquid at 27° F. in demethanizer reboiler 12, and to −33° F. (stream 33*c*) by demethanizer liquid at −44° F. in demethanizer side reboiler 13.

Following cooling, the two streams, 32*a* and 33*c*, recombine as stream 31*a*. The recombined stream then enters separator 14 at −20° F. and 885 psia where the vapor (stream 34) is separated from the condensed liquid (stream 40).

The vapor (stream 34) from separator 14 is divided into gaseous first and second streams, 35 and 39. Stream 35, containing about 30 percent of the total vapor, is combined with the separator liquid (stream 40). The combined stream 36 is cooled to −69° F. and partially condensed in heat exchanger 15 by heat exchange with cool residue gas (stream 43*a*) at −85° F. The partially condensed stream 36*a* is then flash expanded through an appropriate expansion device, such as expansion valve 16, to an intermediate pressure of about 750 psia. The flash expanded stream 36*b*, now at −79° F., enters intermediate separator 17 where the vapor (stream 37) is separated from the condensed liquid (stream 38). The amount of condensation desired for stream 36*b* will depend on a number of factors, including feed gas composition, feed gas pressure, column operating pressure, etc.

The vapor (stream 37) from intermediate separator 17 passes through heat exchanger 18 in heat exchange relation with a portion (stream 44) of the −160° F. cold distillation stream 43, resulting in cooling and substantial condensation of the stream. The substantially condensed stream 37*a* at −155° F. is then flash expanded through an appropriate expansion device, such as expansion valve 19, to the operating pressure (approximately 275 psia) of the fractionation tower 25. During expansion a portion of the stream is vaporized, resulting in cooling of the total stream. In the process illustrated in FIG. 7 the expanded stream 37*b* leaving expansion valve 19 reaches a temperature of −163° F. and is supplied to the fractionation tower as the top column feed. The vapor portion (if any) of stream 37*b* combines with the vapors rising from the top fractionation stage of the column to form distillation stream 43, which is withdrawn from an upper region of the tower.

The liquid (stream 38) from intermediate separator 17 is subcooled in exchanger 20 by heat exchange with the remaining portion of cold distillation stream 43 (stream 45). The subcooled stream 38*a* at −155° F. is similarly expanded to 275 psia by expansion valve 21. The expanded stream 38*b* then enters the distillation column or demethanizer at a first mid-column feed position. The distillation column is in a lower region of fractionation tower 25.

Returning to the gaseous second stream 39, the remaining 70 percent of the vapor from separator 14 enters an expansion device such as work expansion machine 22 in which mechanical energy is extracted from this portion of the high pressure feed. The machine 22 expands the vapor substantially isentropically from a pressure of about 885 psia to the pressure of the demethanizer (about 275 psia), with the work expansion cooling the expanded stream to a temperature of approximately −104° F. (stream 39*a*). The expanded and partially condensed stream 39*a* is supplied as feed to the distillation column at a second mid-column feed point.

The liquid product, stream 51, exits the bottom of tower 25 at 42° F. and is pumped to a pressure of approximately 805 psia in demethanizer bottoms pump 29. The pumped liquid product is then warmed to 115° F. as it provides cooling of stream 33 in exchanger 11.

The cold distillation stream 43 from the upper section of the demethanizer is divided into two portions, streams 44 and 45. Stream 44 passes countercurrently to the intermediate separator vapor, stream 37, in heat exchanger 18 where it is warmed to −85° F. (stream 44*a*) as it provides cooling and substantial condensation of vapor stream 37. Similarly, stream 45 passes countercurrently to the intermediate separator liquid, stream 38, in heat exchanger 20 where it is warmed to −84° F. (stream 45*a*) as it provides subcooling of liquid stream 38. The two partially warmed streams 44*a* and 45*a* then recombine as stream 43*a*, at a temperature of −85° F. This recombined stream passes countercurrently to the incoming feed gas in heat exchanger 15 where it is heated to −25° F. (stream 43*b*) and heat exchanger 10 where it is heated to 109° F. (stream 43*c*). A portion of the stream (1.5%) is withdrawn at this point (stream 48) to be used as fuel gas for the plant; the remainder (stream 49) is then re-compressed in two stages. The first stage is compressor 23 driven by expansion machine 22, followed by aftercooler 26. The second stage is compressor 27 driven by a supplemental power source which compresses the residue gas to sales line pressure (stream 49*c*). After cooling in discharge cooler 28, the residue gas product (stream 49*d*) flows to the sales gas pipeline at 120° F. and 900 psia.

A summary of stream flow rates and energy consumption for the process illustrated in FIG. 7 is set forth in the table below:

TABLE IV (FIG. 7)
Stream Flow Summary - (Lb. Moles/Hr)

| Stream | Methane | Ethane | Propane | Butanes+ | Total |
|---|---|---|---|---|---|
| 31 | 23630 | 2152 | 901 | 493 | 27451 |
| 34 | 22868 | 1870 | 622 | 180 | 25808 |
| 40 | 762 | 282 | 279 | 313 | 1643 |
| 35 | 6823 | 558 | 186 | 54 | 7700 |
| 39 | 16045 | 1312 | 436 | 126 | 18108 |
| 37 | 4397 | 174 | 34 | 7 | 4669 |
| 38 | 3188 | 666 | 431 | 360 | 4674 |
| 43 | 23572 | 78 | 1 | 0 | 23883 |
| 51 | 58 | 2074 | 900 | 493 | 3568 |
| Recoveries* | | | | | |
| Ethane | | | | 96.36% | |
| Propane | | | | 99.84% | |
| Butanes+ | | | | 99.99% | |
| Horsepower | | | | | |
| Residue Compression | | | | 15,201 | |

*(Based on un-rounded flow rates)

Comparison of the recovery levels displayed in Tables I and IV shows that the present invention improves ethane recovery from 94.46% to 96.36%, propane recovery from 99.50% to 99.84%, and butanes+ recovery from 99.96% to 99.99%. Comparison of Tables I and IV further shows that the improvement in yields was not simply the result of increasing the horsepower (utility) requirements. To the contrary, when the present invention is employed as in Example 1, not only do the ethane, propane, and butanes+ recoveries increase over those of the prior art process, but liquid recovery efficiency also increases by 2.0 percent (in terms of ethane recovered per unit of horsepower expended).

As shown in Tables I, II, and IV, the majority of the $C_{2+}$ components contained in the inlet feed gas enter the demethanizer in the mostly vapor stream (stream 39*a*) leaving the work expansion machine As a result, the quantity of the cold feed streams feeding the upper section of the demethanizer must be large enough to condense these $C_{2+}$ components so that these components can be recovered in the liquid product leaving the bottom of the fractionation column. However, the top feed stream to the demethanizer also must be lean in $C_{2+}$ components to minimize the loss of $C_{2+}$ components in the demethanizer overhead gas due to the equilibrium that exists between the liquid in the top feed and the distillation stream leaving the upper section of the demethanizer.

Comparing the present invention to the prior art process displayed in FIG. 1, Tables I and IV show that the present invention has much lower concentrations of $C_2$, $C_3$, and $C_{4+}$ components in its top feed (stream 37 in Table IV) than the FIG. 1 process (stream 36 in Table I). This reduces the loss of $C_{2+}$ components in the column overhead stream due to equilibrium effects. Comparing the temperature of the upper mid-column feed stream in the FIG. 2 prior art process (stream 38*a*) with that of the upper mid-column feed stream in the present invention (stream 38*b* in FIG. 7), this feed stream is significantly lower in temperature in the present invention. As a result, significantly more refrigeration is supplied to the upper section of the demethanizer to condense the $C_{2+}$ components in the lower feed streams to the column and prevent large amounts of vapor $C_{2+}$ components from rising upward in the tower and impacting the equilibrium in the top section of the column. Thus, the upper mid-column feed stream is cold enough to provide bulk recovery of the $C_{2+}$ components, while the top column feed stream is lean enough to provide rectification of the vapors in the upper section of the column to maintain high ethane recovery.

EXAMPLE 2

Figure 8:
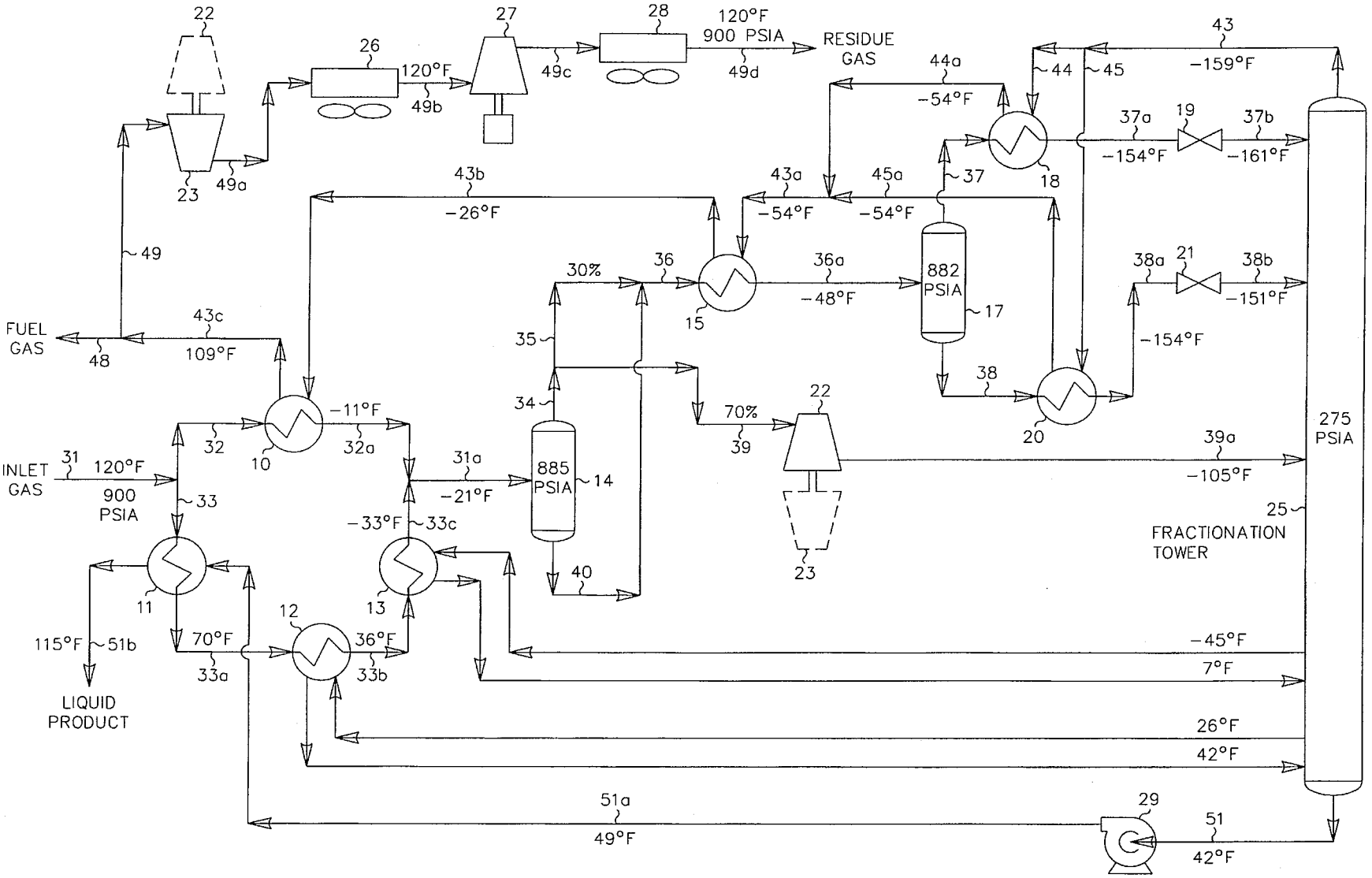
FIGS. 8, 9, 10 and 11 are flow diagrams illustrating alternative means of application of the present invention to a natural gas stream.

FIG. 7 represents the preferred embodiment of the present invention for the temperature and pressure conditions shown because it typically provides the highest ethane recovery. A simpler design that maintains nearly the same $C_2$ component recovery can be achieved using another embodiment of the present invention by operating the intermediate separator at essentially inlet pressure, as illustrated in the FIG. 8 process. The feed gas composition and conditions considered in the process presented in FIG. 8 are the same as those in FIGS. 1 through 7. Accordingly, FIG. 8 can be compared with the FIGS. 1 through 6 processes to illustrate the advantages of the present invention, and can likewise be compared to the embodiment displayed in FIG. 7.

In the simulation of the FIG. 8 process, the inlet gas cooling and expansion scheme is much the same as that used in FIG. 7. The difference lies in the disposition of the partially condensed stream 36*a* leaving heat exchanger 15. Rather than being flash expanded to an intermediate pressure, stream 36*a* flows directly to intermediate separator 17 at −48° F. and 882 psia where the vapor (stream 37) is separated from them condensed liquid (stream 38). The vapor (stream 37) from intermediate separator 17 passes through heat exchanger 18 in heat exchange relation with a portion (stream 44) of the −159° F. cold distillation stream 43, resulting in cooling and substantial condensation of the stream. The substantially condensed stream 37*a* at −154° F. is then flash expanded through an appropriate expansion device, such as expansion valve 19, to the operating pressure (approximately 275 psia) of the fractionation tower 25. The expanded stream 37*b* leaving expansion valve 19 reaches a temperature of −161° F. and is supplied to the fractionation tower as the top column feed. The liquid (stream 38) from intermediate separator 17 is subcooled in exchanger 20 by heat exchange with the remaining portion of cold distillation stream 43 (stream 45). The subcooled stream 38*a* at −154° F. is similarly expanded to 275 psia by expansion valve 21. The expanded stream 38*b* then enters the demethanizer at a first mid-column feed position.

A summary of stream flow rates and energy consumptions for the process illustrated in FIG. 8 is set forth in the table below:

TABLE V (FIG. 8)
Stream Flow Summary - (Lb. Moles/Hr)

| Stream | Methane | Ethane | Propane | Butanes+ | Total |
|---|---|---|---|---|---|
| 31 | 23630 | 2152 | 901 | 493 | 27451 |
| 34 | 22848 | 1864 | 617 | 177 | 25772 |
| 40 | 782 | 288 | 284 | 316 | 1679 |
| 35 | 6777 | 553 | 183 | 53 | 7644 |
| 39 | 16071 | 1311 | 434 | 124 | 18128 |
| 37 | 5938 | 378 | 101 | 26 | 6515 |
| 38 | 1621 | 463 | 366 | 343 | 2808 |
| 43 | 23572 | 89 | 3 | 0 | 23890 |
| 51 | 58 | 2063 | 898 | 493 | 3561 |
| Recoveries* | | | | | |
| Ethane | | | | 95.84% | |
| Propane | | | | 99.69% | |
| Butanes+ | | | | 99.98% | |
| Horsepower | | | | | |
| Residue Compression | | | | 15,201 | |

*(Based on un-rounded flow rates)

Comparison of the recovery levels displayed in Tables I and V for the FIG. 1 and FIG. 8 process shows that this embodiment of the present invention also improves the liquids recovery over that of the prior art process. The ethane recovery improves from 94.46% to 95.84%, the propane recovery improves from 99.50% to 99.69%, and the butanes+ recovery improves from 99.96% to 99.98%. Comparison of the recovery levels displayed in Tables IV and V for the FIG. 7 and FIG. 8 processes shows that only a slight reduction in ethane recovery, from 96.36% to 95.84%, results from utilizing less equipment in the FIG. 8 embodiment of the present invention. These two embodiments of the present invention have essentially the same total horsepower (utility) requirements. The choice of whether to include this additional equipment in the process will generally depend on factors which include plant size and available equipment.

EXAMPLE 3

Figure 9:
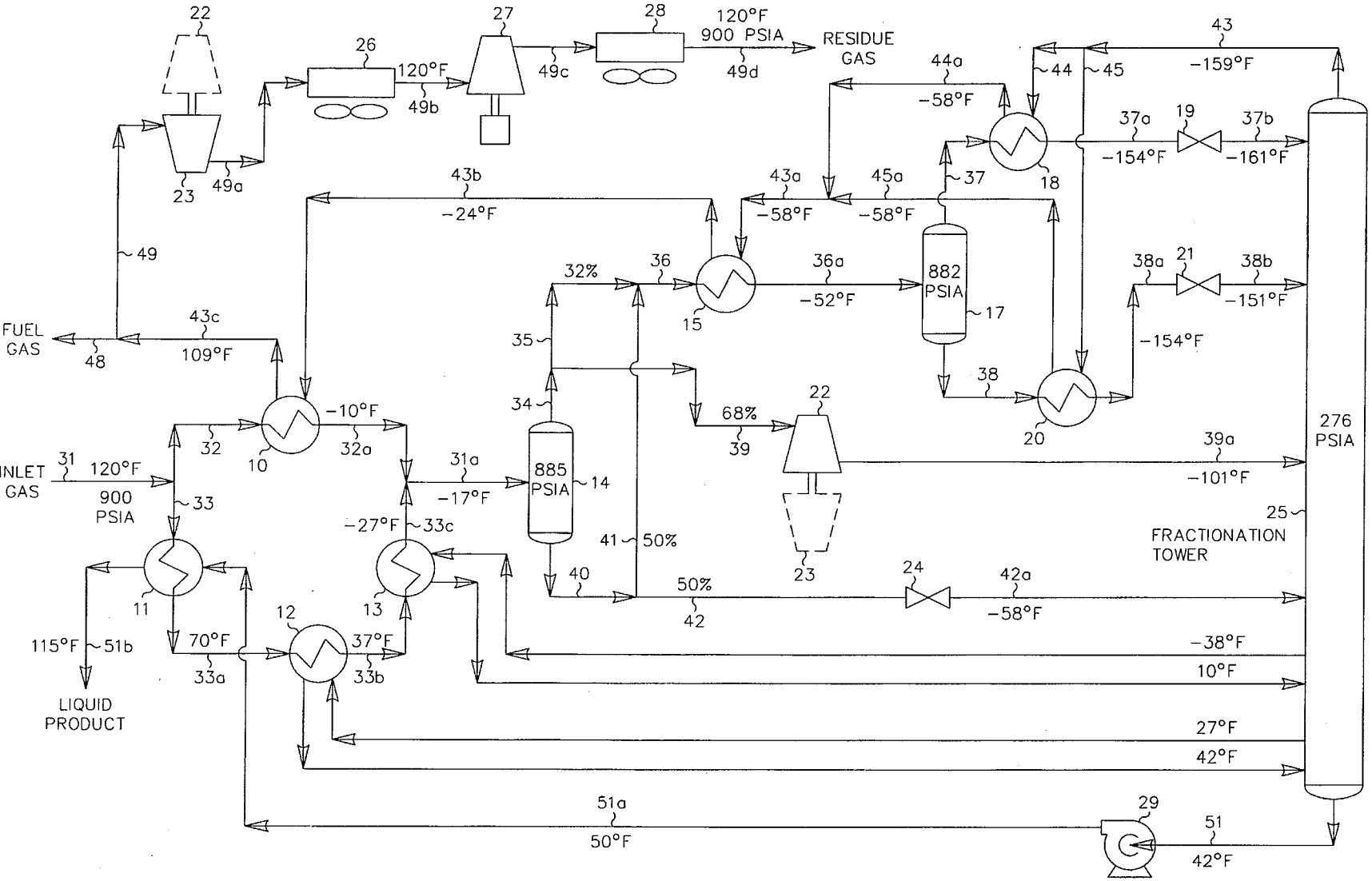

A third embodiment of the present invention is shown in FIG. 9, wherein a portion of the liquids condensed from the incoming feed gas are routed directly to the demethanizer. The feed gas composition and conditions considered in the process illustrated in FIG. 9 are the same as those in FIGS. 1 through 8.

In the simulation of the process of FIG. 9, the inlet gas cooling and expansion scheme is essentially the same as that used in FIG. 8. The difference lies in the disposition of the condensed liquid, stream 40, leaving separator 14. Referring to FIG. 9, stream 40 is divided into two portions, streams 41 and 42. Stream 42, containing about 50 percent of the total condensed liquid, is flash expanded through an appropriate expansion device, such as expansion valve 24, to the operating pressure (approximately 276 psia) of the fractionation tower 25. During expansion a portion of the stream is vaporized, resulting in cooling of the total stream. In the process illustrated in FIG. 9, the expanded stream 42*a* leaving expansion valve 24 reaches a temperature of −58° F. and is supplied to the fractionation tower at a lower mid-column feed point. The remaining portion of the condensed liquid, stream 41, is combined with the gaseous first stream, stream 35, to form combined stream 36. The combined stream 36 is then cooled and separated to form streams 37 and 38 as described earlier for the FIG. 8 embodiment of the present invention.

A summary of stream flow rates and energy consumptions for the process illustrated in FIG. 9 is set forth in the table below:

TABLE VI (FIG. 9)
Stream Flow Summary - (Lb. Moles/Hr)

| Stream | Methane | Ethane | Propane | Butanes+ | Total |
|---|---|---|---|---|---|
| 31 | 23630 | 2152 | 901 | 493 | 27451 |
| 34 | 22958 | 1900 | 647 | 193 | 25967 |
| 40 | 672 | 252 | 254 | 300 | 1484 |
| 35 | 7307 | 605 | 206 | 61 | 8265 |
| 39 | 15651 | 1295 | 441 | 132 | 17702 |
| 41 | 336 | 126 | 127 | 150 | 742 |
| 42 | 336 | 126 | 127 | 150 | 742 |
| 37 | 6496 | 416 | 105 | 24 | 7119 |
| 38 | 1147 | 315 | 228 | 187 | 1888 |
| 43 | 23572 | 91 | 3 | 0 | 23898 |
| 51 | 58 | 2061 | 898 | 493 | 3553 |
| Recoveries* | | | | | |
| Ethane | | | | 95.76% | |
| Propane | | | | 99.70% | |
| Butanes+ | | | | 99.98% | |
| Horsepower | | | | | |
| Residue Compression | | | | 15,199 | |

*(Based on un-rounded flow rates)

Comparison of the recovery levels displayed in Tables V and VI for the FIG.8 and FIG. 9 processes shows that combining only a portion of the condensed liquid (stream 41) from separator 14 with gaseous stream 35 reduces the ethane recovery slightly, from 95.84% to 95.76%, while the propane and butanes+ recoveries are essentially unchanged. All of these recoveries, however, are higher than those displayed in Table I for the prior art FIG. 1 process. If the present invention is applied to a richer gas stream than is used in these examples, where more condensed liquid is produced in separator 14, using only a portion of the condensed liquid to combine with gaseous stream 35 may result in higher ethane recovery levels than if all of the condensed liquid is combined as shown in FIG. 8

EXAMPLE 4

Figure 10:
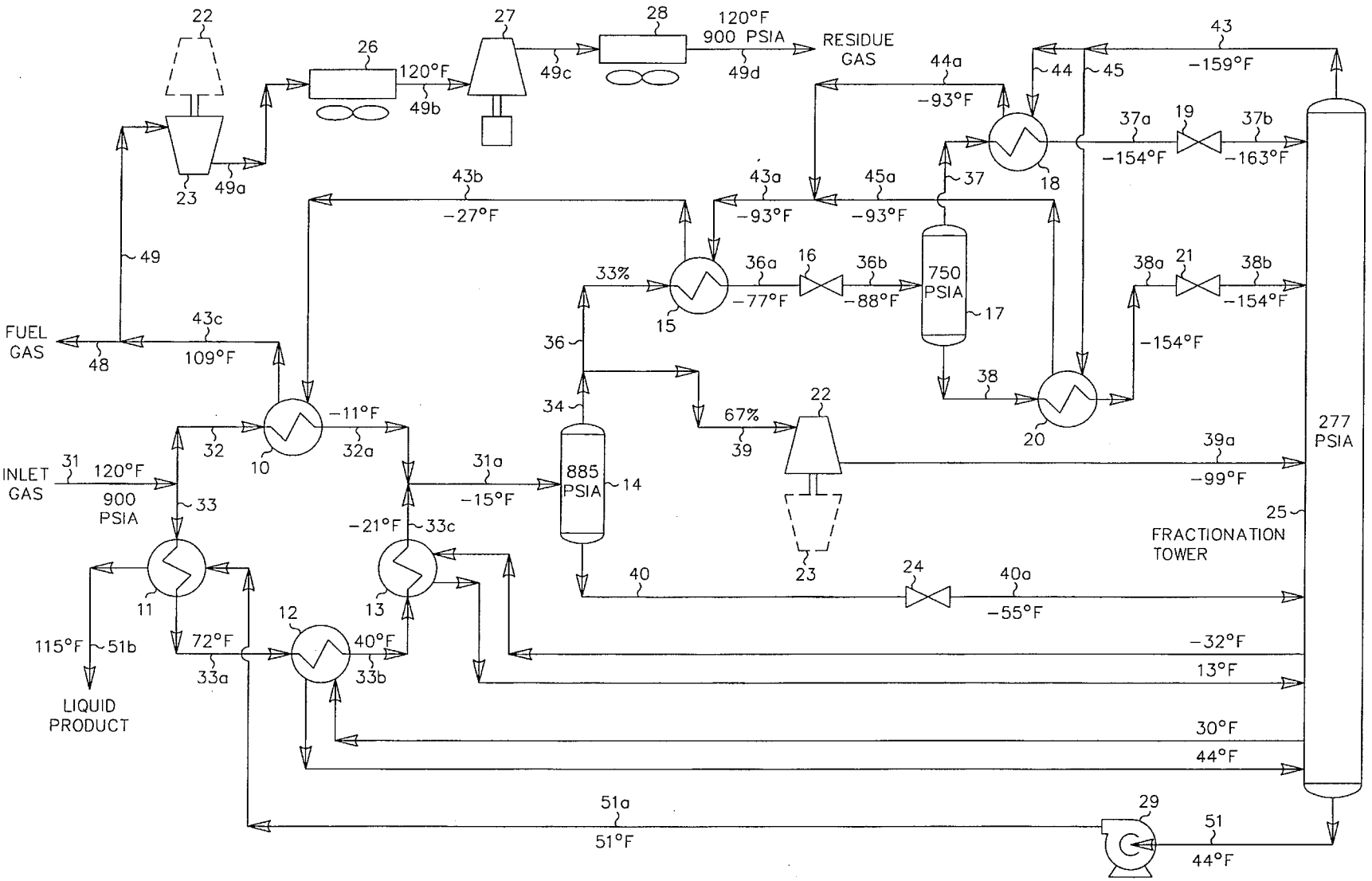

A fourth embodiment of the present invention is shown in FIG. 10, wherein all of the liquids condensed from the incoming feed gas are routed directly to the demethanizer. The feed gas composition and conditions considered in the process illustrated in FIG. 10 are the same as those in FIGS. 1 through 9.

In the simulation of the process of FIG. 10, the inlet gas cooling scheme is essentially the same as that used in FIG. 7. Referring to FIG. 10, the cooled inlet gas stream (stream 31*a*) enters separator 14 at −15° F. and 885 psia where the vapor (stream 34) is separated from the condensed liquid (stream 40). Stream 40 is flash expanded through an appropriate expansion device, such as expansion valve 24, to the operating pressure (approximately 277 psia) of the fractionation tower 25. During expansion a portion of the stream is vaporized, resulting in cooling of the total stream. In the process illustrated in FIG. 10, the expanded stream 40*a* leaving expansion valve 24 reaches a temperature of −55° F. and is supplied to the fractionation tower at a lower mid-column feed point.

The vapor (stream 34) from separator 14 is divided into gaseous first and second streams, 36 and 39. Stream 36, containing about 33 percent of the total vapor, is cooled to −77° F. and partially condensed in heat exchanger 15 by heat exchange with cool residue gas (stream 43*a*) at −93° F. The partially condensed stream 36*a* is then flash expanded through an appropriate expansion device, such as expansion valve 16, to an intermediate pressure of about 750 psia. The flash expanded stream 36*b*, now at −88° F., enters intermediate separator 17 where the vapor (stream 37) is separated from the condensed liquid (stream 38).

The vapor (stream 37) from intermediate separator 17 passes through heat exchanger 18 in heat exchange relation with a portion (stream 44) of the −159° F. cold distillation stream 43, resulting in cooling and substantial condensation of the stream. The substantially condensed stream 37*a* at −154° F. is then flash expanded through an appropriate expansion device, such as expansion valve 19, to the operating pressure of the fractionation tower 25. During expansion a portion of the stream is vaporized, resulting in cooling of the total stream. The expanded stream 37*b* leaving expansion valve 19 reaches a temperature of −163° F. and is supplied to the fractionation tower as the top column feed.

The liquid (stream 38) from intermediate separator 17 is subcooled in exchanger 20 by heat exchange with the remaining portion of cold distillation stream 43 (stream 45). The subcooled stream 38*a* at −154° F. is similarly expanded to 277 psia by expansion valve 21. The expanded stream 38*b* then enters the demethanizer 25 at a first mid-column feed position.

Returning to the gaseous second stream 39, the remaining 67 percent of the vapor from separator 14 enters an expansion device such as work expansion machine 22 in which mechanical energy is extracted from this portion of the high pressure feed. The machine 22 expands the vapor substantially isentropically from a pressure of about 885 psia to the pressure of the demethanizer (about 277 psia), with the work expansion cooling the expanded stream to a temperature of approximately −99° F. (stream 39*a*). The expanded and partially condensed stream 39*a* is supplied as feed to the distillation column at a second mid-column feed point.

A summary of stream flow rates and energy consumptions for the process illustrated in FIG. 10 is set forth in the table below:

TABLE VII (FIG. 10)
Stream Flow Summary - (Lb. Moles/Hr)

| Stream | Methane | Ethane | Propane | Butanes+ | Total |
|---|---|---|---|---|---|
| 31 | 23630 | 2152 | 901 | 493 | 27451 |
| 34 | 23016 | 1920 | 663 | 202 | 26071 |
| 40 | 614 | 232 | 238 | 291 | 1380 |
| 36 | 7628 | 636 | 220 | 67 | 8640 |
| 39 | 15388 | 1284 | 443 | 135 | 17431 |
| 37 | 4598 | 185 | 30 | 4 | 4877 |
| 38 | 3030 | 451 | 190 | 63 | 3763 |
| 43 | 23572 | 97 | 1 | 0 | 23921 |
| 51 | 58 | 2055 | 900 | 493 | 3530 |
| | Recoveries* | | | | |
| | Ethane | | | 95.50% | |
| | Propane | | | 99.85% | |
| | Butanes+ | | | 99.99% | |
| | Horsepower | | | | |
| | Residue Compression | | | 15,199 | |

*(Based on un-rounded flow rates)

Comparison of the recovery levels displayed in Tables IV and VII for the FIG. 7 and FIG. 10 processes shows that not combining any portion of the condensed liquid (stream 40) from separator 14 with gaseous stream 36 reduces the ethane recovery somewhat, from 96.36% to 95.50%, while the propane and butanes+ recoveries are essentially unchanged. All of these recoveries, however, are higher than those displayed in Table I for the prior art FIG. 1 process. If the present invention is applied to a richer gas stream than is used in these examples, where more condensed liquid is produced in separator 14, choosing not to combine the condensed liquid with gaseous stream 36 may result in higher ethane recovery levels than if all of the condensed liquid is combined as shown in FIG. 7.

EXAMPLE 5

Figure 11:
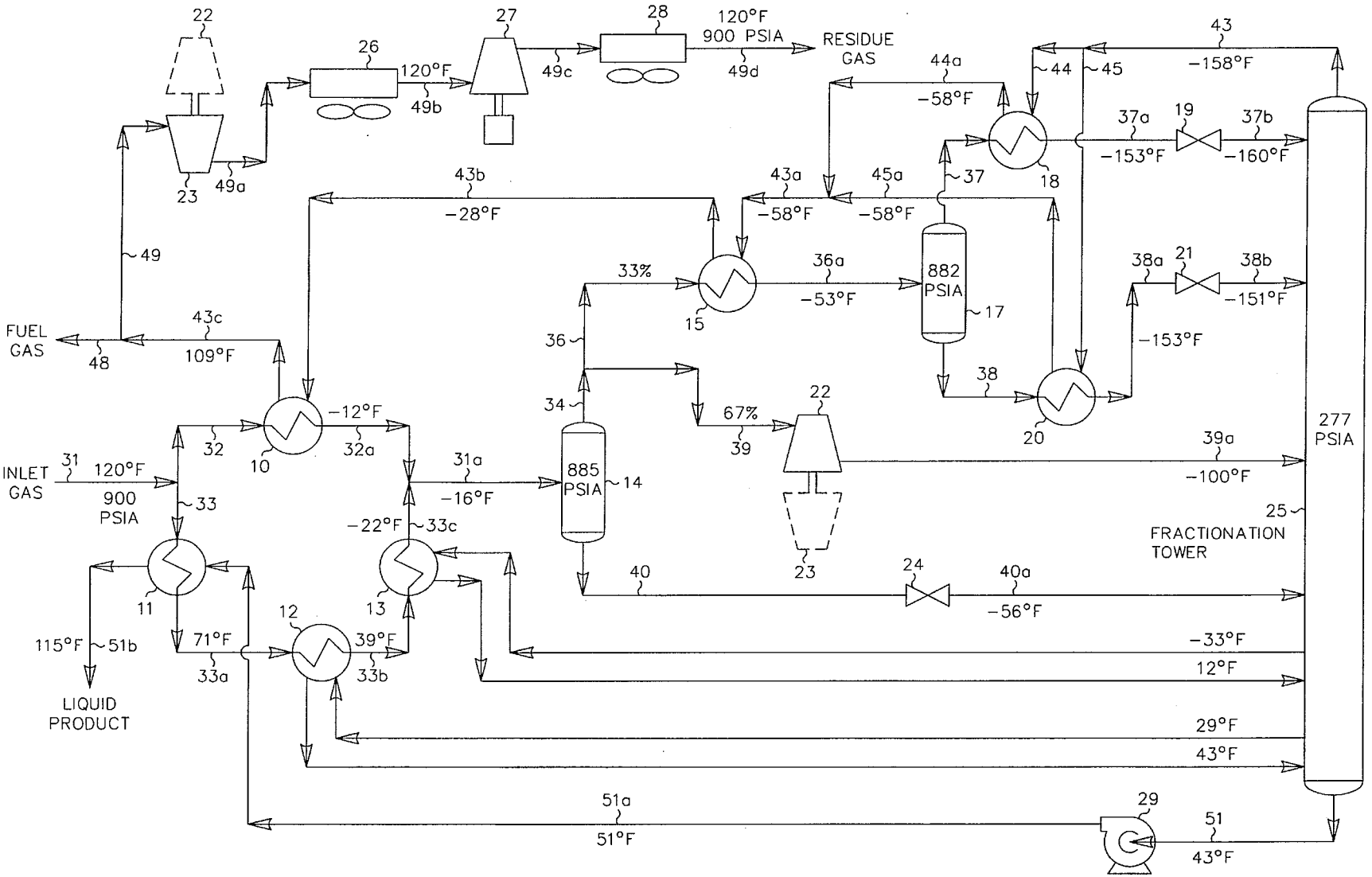

A fifth embodiment of the present invention is shown in FIG. 11, wherein all of the liquids condensed from the incoming feed gas are routed directly to the demethanizer and the intermediate separator is operated at essentially inlet pressure. The feed gas composition and conditions considered in the process illustrated in FIG. 11 are the same as those in FIGS. 1 through 10.

In the simulation of the FIG. 11 process, the inlet gas cooling and expansion scheme is much the same as that used in FIG. 10. The difference lies in the disposition of the partially condensed stream **36*a* leaving heat exchanger 15. Rather than being flash expanded to an intermediate pressure, stream 36*a* flows directly to intermediate separator 17 at −53° F. and 882 psia where the vapor (stream 37) is separated from the condensed liquid (stream 38). The vapor (stream 37) from intermediate separator 17 passes through heat exchanger 18 in heat exchange relation with a portion (stream 44) of the −158° F. cold distillation stream 43, resulting in cooling and substantial condensation of the stream. The substantially condensed stream 37*a* at −153° F. is then flash expanded through an appropriate expansion device, such as expansion valve 19, to the operating pressure (approximately 277 psia) of the fractionation tower 25. The expanded stream 37*b* leaving expansion valve 19 reaches a temperature of −160° F. and is supplied to the fractionation tower as the top column feed. The liquid (stream 38) from intermediate separator 17 is subcooled in exchanger 20 by heat exchange with the remaining portion of cold distillation stream 43 (stream 45). The subcooled stream 38*a* at −153° F. is similarly expanded to 277 psia by expansion valve 21. The expanded stream 38*b*** then enters the demethanizer at a mid-column feed position.

A summary of stream flow rates and energy consumptions for the process illustrated in FIG. 11 is set forth in the table below:

TABLE VIII (FIG. 11)
Stream Flow Summary - (Lb. Moles/Hr)

| Stream | Methane | Ethane | Propane | Butanes+ | Total |
|---|---|---|---|---|---|
| 31 | 23630 | 2152 | 901 | 493 | 27451 |
| 34 | 22982 | 1909 | 653 | 196 | 26010 |
| 40 | 648 | 243 | 248 | 297 | 1441 |
| 36 | 7550 | 627 | 214 | 64 | 8545 |
| 39 | 15432 | 1282 | 439 | 132 | 17465 |
| 37 | 7094 | 505 | 131 | 24 | 7838 |
| 38 | 456 | 122 | 83 | 40 | 707 |
| 43 | 23573 | 108 | 3 | 0 | 23924 |
| 51 | 57 | 2044 | 898 | 493 | 3527 |
| | Recoveries* | | | | |
| | Ethane | | | 95.00% | |
| | Propane | | | 99.65% | |
| | Butanes+ | | | 99.98% | |
| | Horsepower | | | | |
| | Residue Compression | | | 15,202 | |

*(Based on un-rounded flow rates)

Comparison of the recovery levels displayed in Tables VII and VIII for the FIG. 10 and FIG. 11 processes shows that a slight reduction in ethane recovery, from 95.50% to 95.00%, results from utilizing less equipment in the FIG. 11 embodiment of the present invention. The ethane recovery, however, is higher than that displayed in Table I for the prior art FIG. 1 process, as are the recoveries of propane and butanes+.

Other Embodiments

Figure 12:
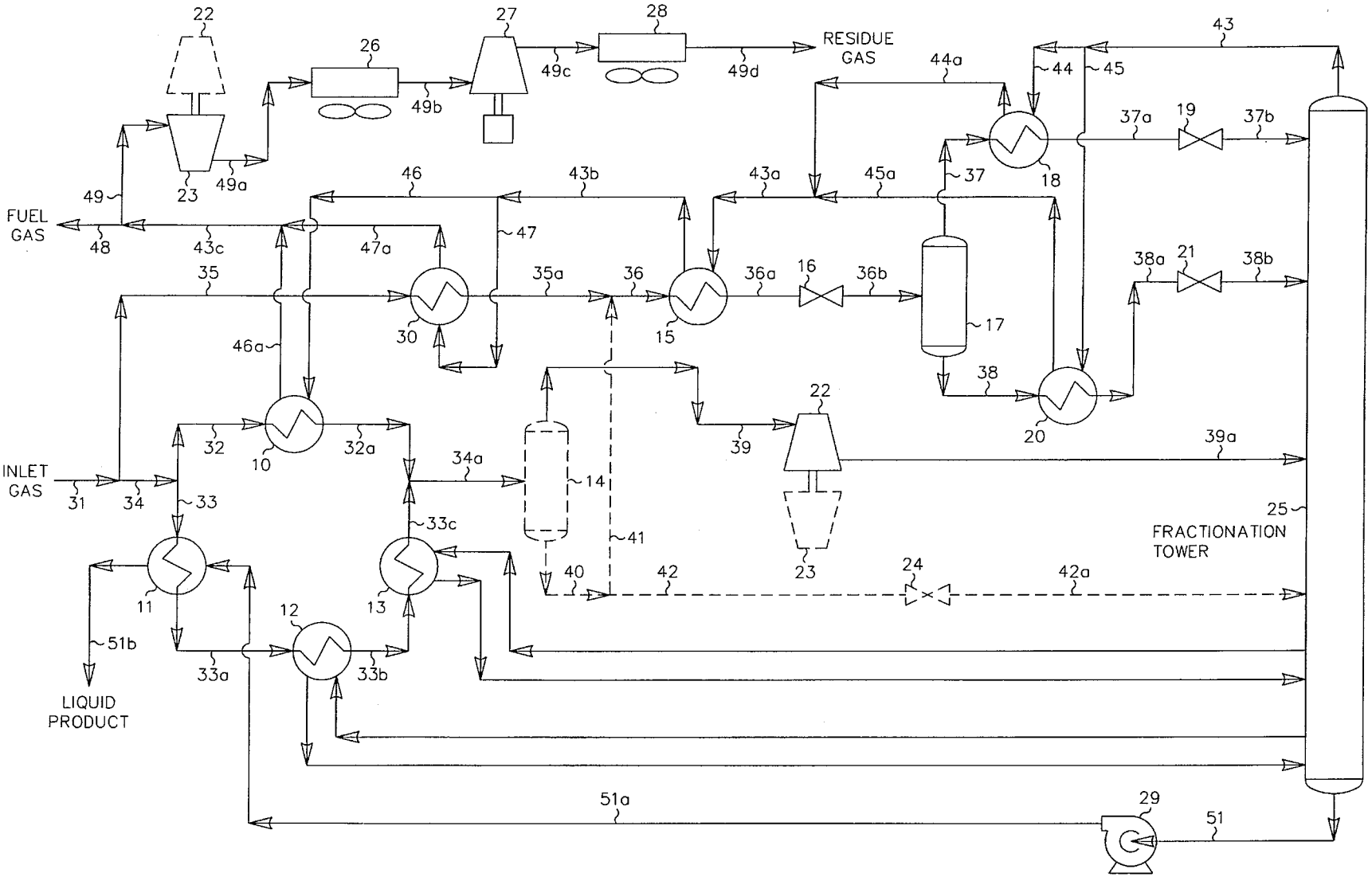
FIGS. 12 and 13 are fragmentary flow diagrams illustrating alternative means of application of the present invention to a natural gas stream.
Figure 13:
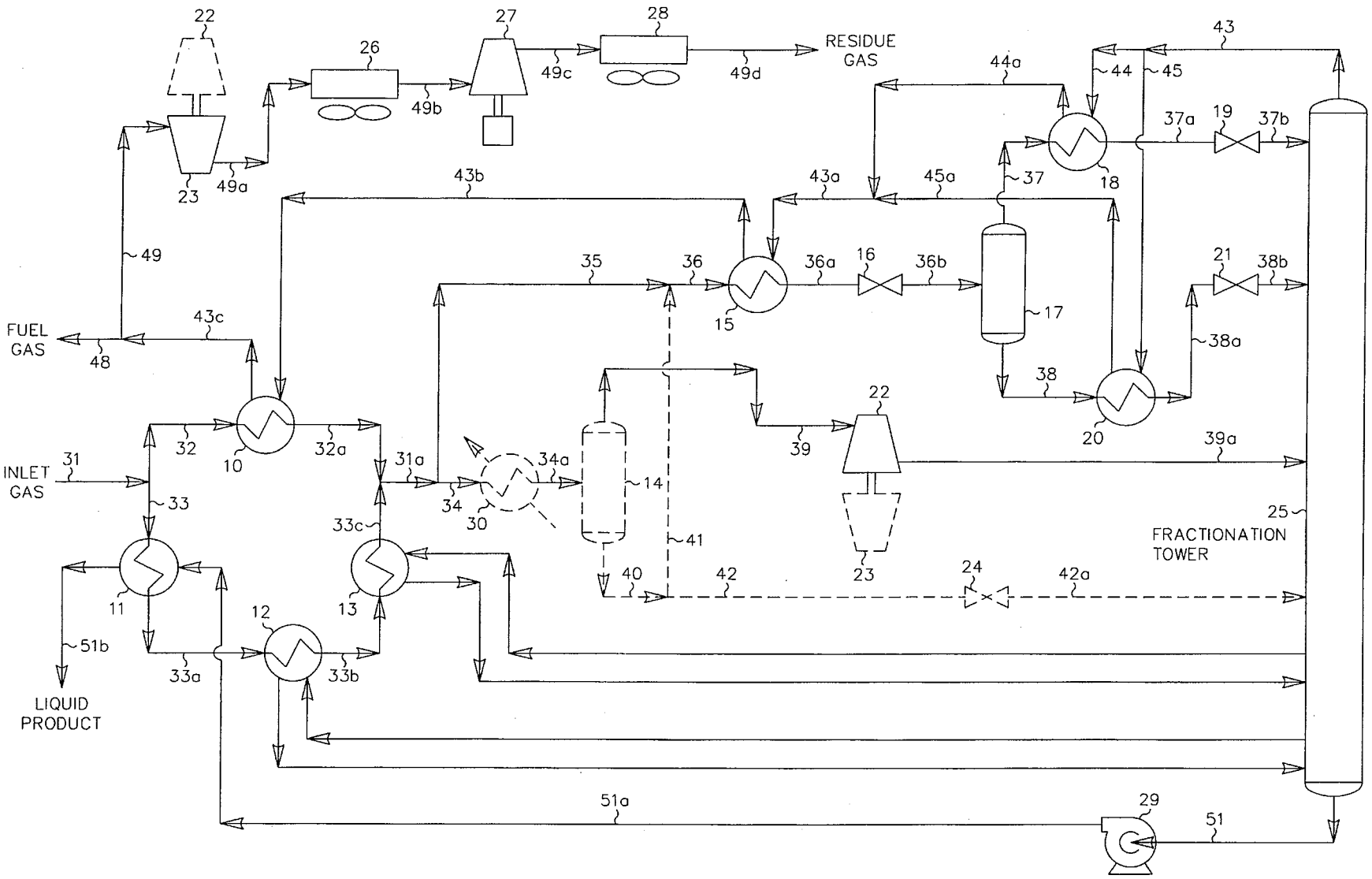

In accordance with this invention, the splitting of the vapor feed may be accomplished in several ways. In the processes of FIGS. 7 through 11, the splitting of vapor occurs following cooling and separation of any liquids which may have been formed. The high pressure gas may be split, however, prior to any cooling of the inlet gas as shown in FIG. 12 or after the cooling of the gas and prior to any separation stages as shown in FIG. 13. In some embodiments, vapor splitting may be effected in a separator. Alternatively, the separator 14 in the processes shown in FIGS. 12 and 13 may be unnecessary if the inlet gas is relatively lean. Moreover, the use of external refrigeration to supplement the cooling available to the inlet gas from other process streams may be employed, particularly in the case of an inlet gas richer than that used in Example 1. The use and distribution of demethanizer liquids for process heat exchange, the particular arrangement of heat exchangers for inlet gas cooling, and the choice of process streams for specific heat exchange services must be evaluated for each particular application. For example, the second stream depicted in FIG. 13, stream 34, may be cooled after division of the inlet stream and prior to expansion of the second stream.

It will also be recognized that the relative amount of feed found in each branch of the split vapor feed (and in the split liquid feed, if applicable) will depend on several factors, including gas pressure, feed gas composition, the amount of heat which can economically be extracted from the feed and the quantity of horsepower available. More feed to the top of the column may increase recovery while decreasing power recovered from the expander thereby increasing the recompression horsepower requirements. Increasing feed lower in the column reduces the horsepower consumption but may also reduce product recovery. The mid-column feed positions depicted in FIGS. 7 through 11 are the preferred feed locations for the process operating conditions described. However, the relative locations of the mid-column feeds may vary depending on inlet composition or other factors such as desired recovery levels and amount of liquid formed during inlet gas cooling. Moreover, two or more of the feed streams, or portions thereof, may be combined depending on the relative temperatures and quantities of individual streams, and the combined stream then fed to a mid-column feed position.

FIGS. 7 through 11 are the preferred embodiments for the compositions and pressure conditions shown. Although individual stream expansion is depicted in particular expansion devices, alternative expansion means may be employed where appropriate. For example, conditions may warrant work expansion of the substantially condensed portion of the feed stream (37*a* in FIG. 7) or the subcooled liquid stream (38*a* in FIG. 7). Moreover, alternate cooling means may also be utilized as circumstances warrant. For instance side reboilers may be used to provide part or all of the cooling for the gaseous streams (stream 36 in FIGS. 7 through 13), the vapor streams (stream 37 in FIGS. 7 through 13) or the liquid streams (stream 38 in FIGS. 7 through 13). Additionally, auto-cooling means such as those depicted in FIG. 9 of U.S. Pat. No. 4,889,545, the disclosure of which is incorporated herein by reference, may be used to cool the separator liquid (stream 40 in FIGS. 7 through 13). The auto-cooled liquid may then be mixed with the gaseous stream downstream of exchanger 15 or flash expanded separately into separator 17. Further, the expanded liquid stream (stream 38*b* in FIGS. 7 through 13 may be used to provide a portion of the cooling to either stream 36 or stream 38 prior to feeding stream 38*b* to the column.

The embodiments shown in FIGS. 7 through 13 can also be used when it is desirable to recover only the $C_3$ components and heavier components (rejection of $C_2$ components and lighter components to the residue gas). This is accomplished by appropriate adjustment of the column feed rates and Conditions. Because of the warmer process operating conditions associated with propane recovery (ethane rejection) operation, the inlet gas cooling scheme is usually different than for the ethane recovery cases illustrated in FIGS. 7 through 13. In such case, the column (generally referred to as a deethanizer rather than a demethanizer) usually includes a reboiler which uses an external source of heat (heating medium, hot process gas, steam, etc.) to heat and vaporize a portion of the liquids flowing down the column to provide the stripping vapors which flow up the column. When operating as a deethanizer (ethane rejection), the tower reboiler temperatures are significantly warmer than when operating as a demethanizer (ethane recovery). Generally this makes it impossible to reboil the tower using plant inlet feed as is typically done for ethane recovery operation.

While there have been described what are believed to be preferred embodiments of the invention, those skilled in the art will recognize that other and further modifications may be made thereto, e.g. to adapt the invention to various conditions, types of feed or other requirements without departing from the spirit of the present invention as defined by the following claims.

We claim:

1. In a process for the separation of a gas stream containing methane, $C_2$ components, $C_3$ components and heavier hydrocarbon components into a volatile residue gas fraction containing a major portion of said methane and a relatively less volatile fraction containing at least a major portion of said $C_3$ components and heavier hydrocarbon components, in which process (a) said gas stream is cooled under pressure to provide a cooled stream;

(b) said cooled stream is expanded to a lower pressure whereby it is further cooled; and (c) said further cooled stream is fractionated at said lower pressure whereby at least a major portion of said $C_3$ components and heavier hydrocarbon components is recovered in said relatively less volatile fraction;

the improvement wherein said gas stream is cooled sufficiently to partially condense it; and (1) said partially condensed gas stream is separated thereby to provide a first vapor stream and a first condensed stream;

(2) said first vapor stream is thereafter divided into gaseous first and second streams;

(3) said gaseous first stream is combined with at least a portion of said first condensed stream to form a combined stream;

(4) said combined stream is cooled and expanded to an intermediate pressure whereby it is partially condensed;

(5) said expanded partially condensed combined stream is separated at said intermediate pressure thereby to provide a second vapor stream and a second condensed stream;

(6) said second vapor stream is further cooled at said intermediate pressure to condense substantially all of it, expanded to said lower pressure, and thereafter supplied at a top feed position to a distillation column in a lower region of a fractionation tower;

(7) said second condensed stream is further cooled at said intermediate pressure, expanded to said lower pressure, and thereafter supplied to said distillation column at a first mid-column feed position;

(8) said gaseous second stream is expanded to said lower pressure and thereafter supplied to said distillation column at a second mid-column feed position; and (9) the quantities and temperatures of said feed streams to the column are effective to maintain the tower overhead temperature at a temperature whereby at least a major portion of said $C_3$ components and heavier hydrocarbon components is recovered in said relatively less volatile fraction.

2. In a process for the separation of a gas stream containing methane, $C_2$ components, $C_3$ components and heavier hydrocarbon components into a volatile residue gas fraction containing a major portion of said methane and a relatively less volatile fraction containing at least a major portion of said $C_3$ components and heavier hydrocarbon components, in which process (a) said gas stream is cooled under pressure to provide a cooled stream;

(b) said cooled stream is expanded to a lower pressure whereby it is further cooled; and (c) said further cooled stream is fractionated at said lower pressure whereby at least a major portion of said $C_3$ components and heavier hydrocarbon components is recovered in said relatively less volatile fraction;

the improvement wherein prior to cooling, said gas stream is divided into gaseous first and second streams; and (1) said gaseous second stream is cooled sufficiently to partially condense it;

(2) said partially condensed second stream is separated thereby to provide a first vapor stream and a first condensed stream;

(3) said gaseous first stream is cooled and then combined with at least a portion of said first condensed stream to form a combined stream;

(4) said combined stream is cooled and expanded to an intermediate pressure whereby it is partially condensed;

(5) said expanded partially condensed combined stream is separated at said intermediate pressure thereby to provide a second vapor stream and a second condensed stream;

(6) said second vapor stream is further cooled at said intermediate pressure to condense substantially all of it, expanded to said lower pressure, and thereafter supplied at a top feed position to a distillation column in a lower region of a fractionation tower;

(7) said second condensed stream is further cooled at said intermediate pressure, expanded to said lower pressure, and thereafter supplied to said distillation column at a first mid-column feed position;

(8) said first vapor stream is expanded to said lower pressure and thereafter supplied to said distillation column at a second mid-column feed position; and (9) the quantities and temperatures of said feed streams to the column are effective to maintain the tower overhead temperature at a temperature whereby at least a major portion of said $C_3$ components and heavier hydrocarbon components is recovered in said relatively less volatile fraction.

3. In a process for the separation of a gas stream containing methane, $C_2$ components, $C_3$ components and heavier hydrocarbon components into a volatile residue gas fraction containing a major portion of said methane and a relatively less volatile fraction containing at least a major portion of said $C_3$ components and heavier hydrocarbon components, in which process (a) said gas stream is cooled under pressure to provide a cooled stream;

(b) said cooled stream is expanded to a lower pressure whereby it is further cooled; and (c) said further cooled stream is fractionated at said lower pressure whereby at least a major portion of said $C_3$ components and heavier hydrocarbon components is recovered in said relatively less volatile fraction;

the improvement wherein following cooling, said cooled stream is divided into first and second streams; and (1) said second stream is cooled sufficiently to partially condense it;

(2) said partially condensed second stream is separated thereby to provide a first vapor stream and a first condensed stream;

(3) said first stream is combined with at least a portion of said first condensed stream to form a combined stream;

(4) said combined stream is cooled and expanded to an intermediate pressure whereby it is partially condensed;

(5) said expanded partially condensed combined stream is separated at said intermediate pressure thereby to provide a second vapor stream and a second condensed stream;

(6) said second vapor stream is further cooled at said intermediate pressure to condense substantially all of it, expanded to said lower pressure, and thereafter supplied at a top feed position to a distillation column in a lower region of a fractionation tower;

(7) said second condensed stream is further cooled at said intermediate pressure, expanded to said lower pressure, and thereafter supplied to said distillation column at a first mid-column feed position;

(8) said first vapor stream is expanded to said lower pressure and thereafter supplied to said distillation column at a second mid-column feed position; and (9) the quantities and temperatures of said feed streams to the column are effective to maintain the tower overhead temperature at a temperature whereby at least a major portion of said $C_3$ components and heavier hydrocarbon components is recovered in said relatively less volatile fraction.

4. In a process for the separation of a gas stream containing methane, $C_2$ components, $C_3$ components and heavier hydrocarbon components into a volatile residue gas fraction containing a major portion of said methane and a relatively less volatile fraction containing at least a major portion of said $C_3$ components and heavier hydrocarbon components, in which process (a) said gas stream is cooled under pressure to provide a cooled stream;

(b) said cooled stream is expanded to a lower pressure whereby it is further cooled; and (c) said further cooled stream is fractionated at said lower pressure whereby at least a major portion of said $C_3$ components and heavier hydrocarbon components is recovered in said relatively less volatile fraction;

the improvement wherein said gas stream is cooled sufficiently to partially condense it; and (1) said partially condensed gas stream is separated thereby to provide a first vapor stream and a first condensed stream;

(2) said first vapor stream is thereafter divided into gaseous first and second streams;

(3) said gaseous first stream is cooled and expanded to an intermediate pressure whereby it is partially condensed;

(4) said expanded partially condensed first stream is separated at said intermediate pressure thereby to provide a second vapor stream and a second condensed stream;

(5) said second vapor stream is further cooled at said intermediate pressure to condense substantially all of it, expanded to said lower pressure, and thereafter supplied at a top feed position to a distillation column in a lower region of a fractionation tower;

(6) said second condensed stream is further cooled at said intermediate pressure, expanded to said lower pressure, and thereafter supplied to said distillation column at a first mid-column feed position;

(7) said gaseous second stream is expanded to said lower pressure and thereafter supplied to said distillation column at a second mid-column feed position;

(8) at least a portion of said first condensed stream is expanded to said lower pressure and thereafter supplied to said distillation column at a third mid-column feed position; and (9) the quantities and temperatures of said feed streams to the column are effective to maintain the tower overhead temperature at a temperature whereby at least a major portion of said $C_3$ components and heavier hydrocarbon components is recovered in said relatively less volatile fraction.

5. In a process for the separation of a gas stream containing methane, $C_2$ components, $C_3$ components and heavier hydrocarbon components into a volatile residue gas fraction containing a major portion of said methane and a relatively less volatile fraction containing at least a major portion of said $C_3$ components and heavier hydrocarbon components, in which process (a) said gas stream is cooled under pressure to provide a cooled stream;

(b) said cooled stream is expanded to a lower pressure whereby it is further cooled; and (c) said further cooled stream is fractionated at said lower pressure whereby at least a major portion of said $C_3$ components and heavier hydrocarbon components is recovered in said relatively less volatile fraction;

the improvement wherein prior to cooling, said gas stream is divided into gaseous first and second streams; and (1) said gaseous first stream is cooled and expanded to an intermediate pressure whereby it is partially condensed;

(2) said expanded partially condensed first stream is separated at said intermediate pressure thereby to provide a first vapor stream and a first condensed stream;

(3) said first vapor stream is further cooled at said intermediate pressure to condense substantially all of it, expanded to said lower pressure, and thereafter supplied at a top feed position to a distillation column in a lower region of a fractionation tower;

(4) said first condensed stream is further cooled at said intermediate pressure, expanded to said lower pressure, and thereafter supplied to said distillation column at a first mid-column feed position;

(5) said gaseous second stream is cooled sufficiently to partially condense it;

(6) said partially condensed second stream is separated thereby to provide a second vapor stream and a second condensed stream;

(7) said second vapor stream is expanded to said lower pressure and thereafter supplied to said distillation column at a second mid-column feed position;

(8) at least a portion of said second condensed stream is expanded to said lower pressure and thereafter supplied to said distillation column at a third mid-column feed position; and (9) the quantities and temperatures of said feed streams to the column are effective to maintain the tower overhead temperature at a temperature whereby at least a major portion of said $C_3$ components and heavier hydrocarbon components is recovered in said relatively less volatile fraction.

6. In a process for the separation of a gas stream containing methane, $C_2$ components, $C_3$ components and heavier hydrocarbon components into a volatile residue gas fraction containing a major portion of said methane and a relatively less volatile fraction containing at least a major portion of said $C_3$ components and heavier hydrocarbon components, in which process (a) said gas stream is cooled under pressure to provide a cooled stream;

(b) said cooled stream is expanded to a lower pressure whereby it is further cooled; and (c) said further cooled stream is fractionated at said lower pressure whereby at least a major portion of said $C_3$ components and heavier hydrocarbon components is recovered in said relatively less volatile fraction;

the improvement wherein following cooling, said cooled stream is divided into first and second streams; and (1) said first stream is cooled and expanded to an intermediate pressure whereby it is partially condensed;

(2) said expanded partially condensed first stream is separated at said intermediate pressure thereby to provide a first vapor stream and a first condensed stream;

(3) said first vapor stream is further cooled at said intermediate pressure to condense substantially all of it, expanded to said lower pressure, and thereafter supplied at a top feed position to a distillation column in a lower region of a fractionation tower;

(4) said first condensed stream is further cooled at said intermediate pressure, expanded to said lower pressure, and thereafter supplied to said distillation column at a first mid-column feed position;

(5) said second stream is cooled sufficiently to partially condense it;

(6) said partially condensed second stream is separated thereby to provide a second vapor stream and a second condensed stream;

(7) said second vapor stream is expanded to said lower pressure and thereafter supplied to said distillation column at a second mid-column feed position;

(8) at least a portion of said second condensed stream is expanded to said lower pressure and thereafter supplied to said distillation column at a third mid-column feed position; and (9) the quantities and temperatures of said feed streams to the column are effective to maintain the tower overhead temperature at a temperature whereby at least a major portion of said $C_3$ components and heavier hydrocarbon components is recovered in said relatively less volatile fraction.

7. In a process for the separation of a gas stream containing methane, $C_2$ components, $C_3$ components and heavier hydrocarbon components into a volatile residue gas fraction containing a major portion of said methane and a relatively less volatile fraction containing at least a major portion of said $C_3$ components and heavier hydrocarbon components, in which process (a) said gas stream is cooled under pressure to provide a cooled stream;

(b) said cooled stream is expanded to a lower pressure whereby it is further cooled; and (c) said further cooled stream is fractionated at said lower pressure whereby at least a major portion of said $C_3$ components and heavier hydrocarbon components is recovered in said relatively less volatile fraction;

the improvement wherein following cooling, said cooled stream is divided into first and second streams; and (1) said first stream is cooled and expanded to an intermediate pressure whereby it is partially condensed;

(2) said expanded partially condensed first stream is separated at said intermediate pressure thereby to provide a vapor stream and a condensed stream;

(3) said vapor stream is further cooled at said intermediate pressure to condense substantially all of it, expanded to said lower pressure, and thereafter supplied at a top feed position to a distillation column in a lower region of a fractionation tower;

(4) said condensed stream is further cooled at said intermediate pressure, expanded to said lower pressure, and thereafter supplied to said distillation column at a first mid-column feed position;

(5) said second stream is expanded to said lower pressure and there after supplied to said distillation column at a second mid-column feed position; and (6) the quantities and temperatures of said feed streams to the column are effective to maintain the tower overhead temperature at a temperature whereby at least a major portion of said $C_3$ components and heavier hydrocarbon components is recovered in said relatively less volatile fraction.

8. In a process for the separation of a gas stream containing methane, $C_2$ components, $C_3$ components and heavier hydrocarbon components into a volatile residue gas fraction containing a major portion of said methane and a relatively less volatile fraction containing at least a major portion of said $C_3$ components and heavier hydrocarbon components, in which process (a) said gas stream is cooled under pressure to provide a cooled stream;

(b) said cooled stream is expanded to a lower pressure whereby it is further cooled; and (c) said further cooled stream is fractionated at said lower pressure whereby at least a major portion of said $C_3$ components and heavier hydrocarbon components is recovered in said relatively less volatile fraction;

the improvement wherein prior to cooling, said gas stream is divided into gaseous first and second streams; and (1) said gaseous first stream is cooled and expanded to an intermediate pressure whereby it is partially condensed;

(2) said expanded partially condensed first stream is separated at said intermediate pressure thereby to provide a vapor stream and a condensed stream;

(3) said vapor stream is further cooled at said intermediate pressure to condense substantially all of it, expanded to said lower pressure, and thereafter supplied at a top feed position to a distillation column in a lower region of a fractionation tower;

(4) said condensed stream is further cooled at said intermediate pressure, expanded to said lower pressure, and thereafter supplied to said distillation column at a first mid-column feed position;

(5) said gaseous second stream is cooled, then expanded to said lower pressure and thereafter supplied to said distillation column at a second mid-column feed position; and (6) the quantities and temperatures of said feed streams to the column are effective to maintain the tower overhead temperature at a temperature whereby at least a major portion of said $C_3$ components and heavier hydrocarbon components is recovered in said relatively less volatile fraction.

9. In a process for the separation of a gas stream containing methane, $C_2$ components, $C_3$ components and heavier hydrocarbon components into a volatile residue gas fraction containing a major portion of said methane and a relatively less volatile fraction containing at least a major portion of said $C_3$ components and heavier hydrocarbon components, in which process (a) said gas stream is cooled under pressure to provide a cooled stream;

(b) said cooled stream is expanded to a lower pressure whereby it is further cooled; and (c) said further cooled stream is fractionated at said lower pressure whereby at least a major portion of said $C_3$ components and heavier hydrocarbon components is recovered in said relatively less volatile fraction;

the improvement wherein said gas stream is cooled sufficiently to partially condense it; and (1) said partially condensed gas stream is separated thereby to provide a first vapor stream and a first condensed stream;

(2) said first vapor stream is thereafter divided into gaseous first and second streams;

(3) said gaseous first stream is combined with at least a portion of said first condensed stream to form a combined stream;

(4) said combined stream is cooled whereby it is partially condensed;

(5) said cooled partially condensed combined stream is separated under pressure thereby to provide a second vapor stream and a second condensed stream;

(6) said second vapor stream is further cooled under pressure to condense substantially all of it, expanded to said lower pressure, and thereafter supplied at a top feed position to a distillation column in a lower region of a fractionation tower;

(7) said second condensed stream is further cooled under pressure, expanded to said lower pressure, and thereafter supplied to said distillation column at a first mid-column feed position;

(8) said gaseous second stream is expanded to said lower pressure and thereafter supplied to said distillation column at a second mid-column feed position; and (9) the quantities and temperatures of said feed streams to the column are effective to maintain the tower overhead temperature at a temperature whereby at least a major portion of said $C_3$ components and heavier hydrocarbon components is recovered in said relatively less volatile fraction.

10. In a process for the separation of a gas stream containing methane, $C_2$ components, $C_3$ components and heavier hydrocarbon components into a volatile residue gas fraction containing a major portion of said methane and a relatively less volatile fraction containing at least a major portion of said $C_3$ components and heavier hydrocarbon components, in which process (a) said gas stream is cooled under pressure to provide a cooled stream;

(b) said cooled stream is expanded to a lower pressure whereby it is further cooled; and (c) said further cooled stream is fractionated at said lower pressure whereby at least a major portion of said $C_3$ components and heavier hydrocarbon components is recovered in said relatively less volatile fraction;

the improvement wherein prior to cooling, said gas stream is divided into gaseous first and second streams; and (1) said gaseous second stream is cooled sufficiently to partially condense it;

(2) said partially condensed second stream is separated thereby to provide a first vapor stream and a first condensed stream;

(3) said gaseous first stream is cooled and then combined with at least a portion of said first condensed stream to form a combined stream;

(4) said combined stream is cooled whereby it is partially condensed;

(5) said cooled partially condensed combined stream is separated under pressure thereby to provide a second vapor stream and a second condensed stream;

(6) said second vapor stream is further cooled under pressure to condense substantially all of it, expanded to said lower pressure, and thereafter supplied at a top feed position to a distillation column in a lower region of a fractionation tower;

(7) said second condensed stream is further cooled under pressure, expanded to said lower pressure, and thereafter supplied to said distillation column at a first mid-column feed position;

(8) said first vapor stream is expanded to said lower pressure and thereafter supplied to said distillation column at a second mid-column feed position; and (9) the quantities and temperatures of said feed streams to the column are effective to maintain the tower overhead temperature at a temperature whereby at least a major portion of said $C_3$ components and heavier hydrocarbon components is recovered in said relatively less volatile fraction.

11. In a process for the separation of a gas stream containing methane, $C_2$ components, $C_3$ components and heavier hydrocarbon components into a volatile residue gas fraction containing a major portion of said methane and a relatively less volatile fraction containing at least a major portion of said $C_3$ components and heavier hydrocarbon components, in which process (a) said gas stream is cooled under pressure to provide a cooled stream;

(b) said cooled stream is expanded to a lower pressure whereby it is further cooled; and (c) said further cooled stream is fractionated at said lower pressure whereby at least a major portion of said $C_3$ components and heavier hydrocarbon components is recovered in said relatively less volatile fraction;

the improvement wherein following cooling, said cooled stream is divided into first and second streams; and (1) said second stream is cooled sufficiently to partially condense it;

(2) said partially condensed second stream is separated thereby to provide a first vapor stream and a first condensed stream;

(3) said first stream is combined with at least a portion of said first condensed stream to form a combined stream;

(4) said combined stream is cooled whereby it is partially condensed;

(5) said cooled partially condensed combined stream is separated under pressure thereby to provide a second vapor stream and a second condensed stream;

(6) said second vapor stream is further cooled under pressure to condense substantially all of it, expanded to said lower pressure, and thereafter supplied at a top feed position to a distillation column in a lower region of a fractionation tower;

(7) said second condensed stream is further cooled under pressure, expanded to said lower pressure, and thereafter supplied to said distillation column at a first mid-column feed position;

(8) said first vapor stream is expanded to said lower pressure and thereafter supplied to said distillation column at a second mid-column feed position; and (9) the quantities and temperatures of said feed streams to the column are effective to maintain the tower overhead temperature at a temperature whereby at least a major portion of said $C_3$ components and heavier hydrocarbon components is recovered in said relatively less volatile fraction.

12. In a process for the separation of a gas stream containing methane, $C_2$ components, $C_3$ components and heavier hydrocarbon components into a volatile residue gas fraction containing a major portion of said methane and a relatively less volatile fraction containing at least a major portion of said $C_3$ components and heavier hydrocarbon components, in which process (a) said gas stream is cooled under pressure to provide a cooled stream;

(b) said cooled stream is expanded to a lower pressure whereby it is further cooled; and (c) said further cooled stream is fractionated at said lower pressure whereby at least a major portion of said $C_3$ components and heavier hydrocarbon components is recovered in said relatively less volatile fraction;

the improvement wherein said gas stream is cooled sufficiently to partially condense it; and (1) said partially condensed gas stream is separated thereby to provide a first vapor stream and a first condensed stream;

(2) said first vapor stream is thereafter divided into gaseous first and second streams;

(3) said gaseous first stream is cooled whereby it is partially condensed;

(4) said cooled partially condensed first stream is separated under pressure thereby to provide a second vapor stream and a second condensed stream;

(5) said second vapor stream is further cooled under pressure to condense substantially all of it, expanded to said lower pressure, and thereafter supplied at a top feed position to a distillation column in a lower region of a fractionation tower;

(6) said second condensed stream is further cooled under pressure, expanded to said lower pressure, and thereafter supplied to said distillation column at a first mid-column feed position;

(7) said gaseous second stream is expanded to said lower pressure and thereafter supplied to said distillation column at a second mid-column feed position;

(8) at least a portion of said first condensed stream is expanded to said lower pressure and thereafter supplied to said distillation column at a third mid-column feed position; and (9) the quantities and temperatures of said feed streams to the column are effective to maintain the tower overhead temperature at a temperature whereby at least a major portion of said $C_3$ components and heavier hydrocarbon components is recovered in said relatively less volatile fraction.

13. In a process for the separation of a gas stream containing methane, $C_2$ components, $C_3$ components and heavier hydrocarbon components into a volatile residue gas fraction containing a major portion of said methane and a relatively less volatile fraction containing at least a major portion of said $C_3$ components and heavier hydrocarbon components, in which process (a) said gas stream is cooled under pressure to provide a cooled stream;

(b) said cooled stream is expanded to a lower pressure whereby it is further cooled; and (c) said further cooled stream is fractionated at said lower pressure whereby at least a major portion of said $C_3$ components and heavier hydrocarbon components is recovered in said relatively less volatile fraction;

the improvement wherein prior to cooling, said gas stream is divided into gaseous first and second streams; and (1) said gaseous first stream is cooled whereby it is partially condensed;

(2) said cooled partially condensed first stream is separated under pressure thereby to provide a first vapor stream and a first condensed stream;

(3) said first vapor stream is further cooled under pressure to condense substantially all of it, expanded to said lower pressure, and thereafter supplied at a top feed position to a distillation column in a lower region of a fractionation tower;

(4) said first condensed stream is further cooled under pressure, expanded to said lower pressure, and thereafter supplied to said distillation column at a first mid-column feed position;

(5) said gaseous second stream is cooled sufficiently to partially condense it;

(6) said partially condensed second stream is separated thereby to provide a second vapor stream and a second condensed stream;

(7) said second vapor stream is expanded to said lower pressure and thereafter supplied to said distillation column at a second mid-column feed position;

(8) at least a portion of said second condensed stream is expanded to said lower pressure and thereafter supplied to said distillation column at a third mid-column feed position; and (9) the quantities and temperatures of said feed streams to the column are effective to maintain the tower overhead temperature at a temperature whereby at least a major portion of said $C_3$ components and heavier hydrocarbon components is recovered in said relatively less volatile fraction.

14. In a process for the separation of a gas stream containing methane, $C_2$ components, $C_3$ components and heavier hydrocarbon components into a volatile residue gas fraction containing a major portion of said methane and a relatively less volatile fraction containing at least a major portion of said $C_3$ components and heavier hydrocarbon components, in which process (a) said gas stream is cooled under pressure to provide a cooled stream;

(b) said cooled stream is expanded to a lower pressure whereby it is further cooled; and (c) said further cooled stream is fractionated at said lower pressure whereby at least a major portion of said $C_3$ components and heavier hydrocarbon components is recovered in said relatively less volatile fraction;

the improvement wherein following cooling, said cooled stream is divided into first and second streams; and (1) said first stream is cooled whereby it is partially condensed;

(2) said cooled partially condensed first stream is separated under pressure thereby to provide a first vapor stream and a first condensed stream;

(3) said first vapor stream is further cooled under pressure to condense substantially all of it, expanded to said lower pressure, and thereafter supplied at a top feed position to a distillation column in a lower region of a fractionation tower;

(4) said first condensed stream is further cooled under pressure, expanded to said lower pressure, and thereafter supplied to said distillation column at a first mid-column feed position;

(5) said second stream is cooled sufficiently to partially condense it;

(6) said partially condensed second stream is separated thereby to provide a second vapor stream and a second condensed stream;

(7) said second vapor stream is expanded to said lower pressure and thereafter supplied to said distillation column at a second mid-column feed position;

(8) at least a portion of said second condensed stream is expanded to said lower pressure and thereafter supplied to said distillation column at a third mid-column feed position; and (9) the quantities and temperatures of said feed streams to the column are effective to maintain the tower overhead temperature at a temperature whereby at least a major portion of said $C_3$ components and heavier hydrocarbon components is recovered in said relatively less volatile fraction.

15. In a process for the separation of a gas stream containing methane, $C_2$ components, $C_3$ components and heavier hydrocarbon components into a volatile residue gas fraction containing a major portion of said methane and a relatively less volatile fraction containing at least a major portion of said $C_3$ components and heavier hydrocarbon components, in which process (a) said gas stream is cooled under pressure to provide a cooled stream;

(b) said cooled stream is expanded to a lower pressure whereby it is further cooled; and (c) said further cooled stream is fractionated at said lower pressure whereby at least a major portion of said $C_3$ components and heavier hydrocarbon components is recovered in said relatively less volatile fraction;

the improvement wherein following cooling, said cooled stream is divided into first and second streams; and (1) said first stream is cooled whereby it is partially condensed;

(2) said cooled partially condensed first stream is separated under pressure thereby to provide a vapor stream and a condensed stream;

(3) said vapor stream is further cooled under pressure to condense substantially all of it, expanded to said lower pressure, and thereafter supplied at a top feed position to a distillation column in a lower region of a fractionation tower;

(4) said condensed stream is further cooled under pressure, expanded to said lower pressure, and thereafter supplied to said distillation column at a first mid-column feed position;

(5) said second stream is expanded to said lower pressure and thereafter supplied to said distillation column at a second mid-column feed position; and (6) the quantities and temperatures of said feed streams to the column are effective to maintain the tower overhead temperature at a temperature whereby at least a major portion of said $C_3$ components and heavier hydrocarbon components is recovered in said relatively less volatile fraction.

16. In a process for the separation of a gas stream containing methane, $C_2$ components, $C_3$ components and heavier hydrocarbon components into a volatile residue gas fraction containing a major portion of said methane and a relatively less volatile fraction containing at least a major portion of said $C_3$ components and heavier hydrocarbon components, in which process (a) said gas stream is cooled under pressure to provide a cooled stream;

(b) said cooled stream is expanded to a lower pressure whereby it is further cooled; and (c) said further cooled stream is fractionated at said lower pressure whereby at least a major portion of said $C_3$ components and heavier hydrocarbon components is recovered in said relatively less volatile fraction;

the improvement wherein prior to cooling, said gas stream is divided into gaseous first and second streams; and (1) said gaseous first stream is cooled whereby it is partially condensed;

(2) said cooled partially condensed first stream is separated under pressure thereby to provide a vapor stream and a condensed stream;

(3) said vapor stream is further cooled under pressure to condense substantially all of it, expanded to said lower pressure, and thereafter supplied at a top feed position to a distillation column in a lower region of a fractionation tower;

(4) said condensed stream is further cooled under pressure, expanded to said lower pressure, and thereafter supplied to said distillation column at a first mid-column feed position;

(5) said gaseous second stream is cooled, then expanded to said lower pressure and thereafter supplied to said distillation column at a second mid-column feed position; and (6) the quantities and temperatures of said feed streams to the column are effective to maintain the tower overhead temperature at a temperature whereby at least a major portion of said $C_3$ components and heavier hydrocarbon components is recovered in said relatively less volatile fraction.

17. The improvement according to claim 1, 2, 3, 4, 5, 6, 7, 8, 9, 10, 11, 12, 13, 14, 15 or 16 wherein the quantities and temperatures of said feed streams to the column are effective to maintain the tower overhead temperature at a temperature whereby at least a major portion of said $C_2$ components, $C_3$ components and heavier hydrocarbon components is recovered in said relatively less volatile fraction.

* * * * *

UNITED STATES PATENT AND TRADEMARK OFFICE

CERTIFICATE OF CORRECTION

PATENT NO. : 5,555,748

DATED : September 17, 1996

INVENTOR(S) : Roy E. Campbell, John D. Wilkinson, Hank M. Hudson and Michael C. Pierce It is certified that error appears in the above-indentified patent and that said Letters Patent is hereby corrected as shown below:

Col. 3, line 2, "lighters" should read --lighter--

Col. 5, line 31, "gas stream" should read --gas (stream--

Col. 11, line 4, "machine As" should read --machine. As--

Col. 11, line 60, "them" should read --the--

Col. 17, line 38, "13" should read --13)--

Col. 17, line 46, "Conditions" should read --conditions--

Col. 23, line 11, "there after" should read --thereafter--

Signed and Sealed this

Twenty-fourth Day of December, 1996

*Attest:*

Bruce Lehman

BRUCE LEHMAN

*Attesting Officer*

*Commissioner of Patents and Trademarks*